US011282691B2

(12) United States Patent
Bajic et al.

(10) Patent No.: US 11,282,691 B2
(45) Date of Patent: Mar. 22, 2022

(54) ION SOURCE

(71) Applicant: Micromass UK Limited, Wilmslow (GB)

(72) Inventors: Stevan Bajic, Sale (GB); David S. Douce, Congleton (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/956,809

(22) PCT Filed: Dec. 21, 2018

(86) PCT No.: PCT/EP2018/086652
§ 371 (c)(1),
(2) Date: Jun. 22, 2020

(87) PCT Pub. No.: WO2019/122358
PCT Pub. Date: Jun. 27, 2019

(65) Prior Publication Data

US 2021/0066059 A1 Mar. 4, 2021

(30) Foreign Application Priority Data

Dec. 22, 2017 (GB) ..... 1721700

(51) Int. Cl.
*H01J 49/14* (2006.01)
*H01J 27/20* (2006.01)
(Continued)

(52) U.S. Cl.
CPC ..... *H01J 49/14* (2013.01); *H01J 27/20* (2013.01); *H01J 49/0031* (2013.01); *H01J 49/049* (2013.01); *H01J 49/165* (2013.01)

(58) Field of Classification Search
CPC ..... H01J 49/14; H01J 27/20; H01J 49/0031; H01J 49/049; H01J 49/165
(Continued)

(56) References Cited

U.S. PATENT DOCUMENTS 5,294,797 A 3/1994 Frey et al.
10,345,281 B2 * 7/2019 Kelley ..... G01N 33/227
(Continued)

FOREIGN PATENT DOCUMENTS

GB 2252160 A 7/1992
GB 2255856 A 11/1992
(Continued)

OTHER PUBLICATIONS

Martinez-Lozano, P. et al., "Secondary Electrospray Ionization (SESI) of Ambient Vapors for Explosive Detection at Concentrations Below Parts Per Trillion", American Society for Mass Spectrometry 20:287-294 (2009).
(Continued)

*Primary Examiner* — Nicole M Ippolito
(74) *Attorney, Agent, or Firm* — Kacvinsky Daisak Bluni PLLC

(57) ABSTRACT

A method of ionizing a sample is disclosed that comprises heating a sample so that analyte is released from the sample, producing charged particles such as charged droplets downstream of the sample, and using the charged particles to ionize at least some of the analyte released from the sample so as to produce analyte ions.

17 Claims, 10 Drawing Sheets

(51) Int. Cl.

| | |
|---|---|
| ***H01J 49/00*** | (2006.01) |
| ***H01J 49/04*** | (2006.01) |
| ***H01J 49/16*** | (2006.01) |

(58) Field of Classification Search
USPC ..... 250/423 R, 424, 281, 282, 283, 288
See application file for complete search history.

(56) References Cited

U.S. PATENT DOCUMENTS

| | | | | |
|---|---|---|---|---|
| 2003/0111600 | A1 | 6/2003 | Thomson et al. | |
| 2008/0067352 | A1 | 3/2008 | Wang | |
| 2008/0308722 | A1 | 12/2008 | Shiea | |
| 2009/0250608 | A1* | 10/2009 | Mordehai ..... | H01J 49/167 250/288 |
| 2010/0078550 | A1* | 4/2010 | Wiseman ..... | G01N 1/405 250/282 |
| 2013/0026359 | A1 | 1/2013 | Kumashiro et al. | |
| 2015/0187558 | A1 | 7/2015 | Mills et al. | |

FOREIGN PATENT DOCUMENTS

| | | | |
|---|---|---|---|
| GB | 2410370 | A | 7/2005 |
| GB | 2420007 | A | 5/2006 |
| GB | 2434911 | A | 8/2007 |
| GB | 2475742 | A | 6/2011 |
| WO | 2012143737 | A1 | 10/2012 |
| WO | 2015128661 | A1 | 9/2015 |

OTHER PUBLICATIONS

Search Report under Section 17(5) for United Kingdom Patent Application No. GB1721700.1, dated Jul. 6, 2018, 5 pages.
International Search Report and Written Opinion for International Patent Application No. PCT/EP2018/086652, dated Sep. 4, 2019, 21 pages.
Combined Search and Examination Report under Sections 17 & 18(3) for United Kingdom Patent Application No. GB 1820996.5, dated Jun. 28, 2019, 8 pages.

* cited by examiner

ION SOURCE

CROSS-REFERENCE TO RELATED APPLICATIONS

This application is a national phase filing claiming the benefit of and priority to International Patent Application No. PCT/EP2018/086652, filed on Dec. 21, 2018, which claims priority from and the benefit of United Kingdom patent application No. 1721700.1 filed on Dec. 22, 2017. The entire contents of these applications are incorporated herein by reference.

FIELD OF THE INVENTION

The present invention relates generally to an ion source and a method of ionizing a sample, and in particular to a mass and/or ion mobility spectrometer and a method of mass and/or ion mobility spectrometry.

BACKGROUND

Commercial detector systems that are used for the detection of explosives at places such as airports typically operate with a sequence of events that comprises sample collection, ionization, ion separation and ion detection. Sample collection is normally conducted by wiping a cotton swab against the surface that is under investigation. The sample is then transferred to the detector system and ionized using the ionization source of the detector system.

Traditionally, these systems have used radioactive Ni-63 ionizers, although, more recently, these have been superseded by Dielectric Barrier Discharge (DBD) and photoionization sources. However, these sources tend to favour volatile analytes and can be ineffective for the ionization of involatile and thermally labile samples.

WO 2012/143737 (Micromass) discloses an ion source comprising a nebuliser and a target, where the nebuliser emits a stream of analyte droplets which are impacted upon the target in order to ionize the analyte. WO 2015/128661 (Micromass) discloses an ion source comprising a nebuliser, an impactor target arranged downstream of the nebuliser, and a sample target arranged downstream of the impactor target.

It is desired to provide an improved method of ionization.

SUMMARY

According to an aspect there is provided a method of ionizing a sample comprising:

heating a sample so that analyte is released from the sample;

producing charged particles downstream of the sample; and using the charged particles to ionize at least some of the analyte released from the sample so as to produce analyte ions.

Various embodiments are directed to a method of ionizing a sample in which analyte is released from a sample by heating the sample, and then at least some of the released analyte is ionized using charged particles such as charged solvent droplets.

Thus, in contrast with WO 2012/143737, a sample is ionized by heating the sample and then using charged particles (e.g. charged solvent droplets) to ionize at least some of the released analyte.

Furthermore, and in contrast with WO 2015/128661, in various embodiments the charged particles (e.g. charged solvent droplets) are produced downstream of the heated sample.

As will be described in more detail below, the Applicants have surprisingly found that even though the charged particles (e.g. charged solvent droplets) that are used to ionize the analyte are produced downstream of the sample, the ion source according to various embodiments can be used to ionize analyte so as to produce analyte ions. Moreover, the Applicants have found that the ion source according to various embodiments can provide a significantly improved ionization efficiency, in particular for involatile and/or thermally labile analytes such as involatile explosives. As such, the techniques according to various embodiments are particularly beneficial for ionizing and detecting involatile and/or thermally labile substances such as involatile explosives.

It will accordingly be appreciated that various embodiments provide an improved method of ionization.

The charged particles may comprise charged droplets.

The charged droplets may comprise charged solvent droplets.

The charged droplets may comprise (i) water; (ii) formic acid and/or another organic acid; (iii) acetonitrile; and/or (iv) methanol.

Producing charged particles downstream of the sample may comprise causing droplets to impact upon an impactor target.

Producing charged particles downstream of the sample may comprise causing droplets to impact upon the impactor target so as to produce the charged droplets and/or so as to aid the production of charged droplets and/or ions.

The impactor target may be located downstream of the sample.

The droplets may be emitted from a sprayer outlet.

The sprayer outlet may be located downstream of the sample.

Producing charged particles downstream of the sample may comprise emitting the charged droplets from a sprayer outlet.

The sprayer outlet may be located downstream of the sample.

Producing charged particles downstream of the sample may comprise providing liquid to a sprayer with a flow rate of (i) ≥100 μL/min; (ii) ≥200 μL/min; (iii) ≥300 μL/min; (iv) ≥400 μL/min; or (v) ≥500 μL/min.

The charged particles may comprise a plasma.

The charged particles may comprise an electric discharge such as a corona discharge.

Heating the sample may comprise:

emitting a heated gas from a heated gas outlet; and using the heated gas to heat the sample so that the analyte is released from the sample.

The sample may be located downstream of the heated gas outlet.

The method may comprise the heated gas urging at least some of the analyte released from the sample downstream of the sample so that at least some of the analyte is ionized by the charged particles.

Heating the sample may comprise heating the sample using a flash vaporization device.

The method may comprise performing the steps of heating the sample, producing charged particles downstream of the sample, and using the charged particles to ionize at least some of the analyte in a first mode of operation.

The method may comprise in a second different mode of operation producing charged particles upstream of the sample, and using the charged particles to ionize at least some of the sample so as to produce analyte ions.

The method may be performed at ambient and/or atmospheric pressure and/or conditions.

The method may comprise passing the analyte ions into an analytical instrument via an ion inlet of the analytical instrument.

The sprayer outlet may be located at a first distance $x_1$ in a first direction from the ion inlet.

The sample may be located at a second distance $x_2$ in the first direction from the ion inlet.

The second distance $x_2$ may be larger than the first distance $x_1$.

The sprayer outlet may be located at a first distance $x_1$ in a first direction from the ion inlet.

The sample may be located at a second distance $x_2$ in the first direction from the ion inlet.

The second distance $x_2$ may be less than the first distance $x_1$.

According to an aspect there is provided a method of analysing a sample comprising:

ionizing a sample using the method described above;

analysing the analyte ions; and determining whether the analyte comprises an involatile substance on the basis of the analysis.

According to an aspect there is provided a method of detecting an involatile substance comprising:

using charged droplets to ionize a sample so as to produce analyte ions;

analysing the analyte ions; and determining whether the sample comprises an involatile substance on the basis of the analysis.

The method may comprise determining whether the sample comprises an involatile explosive on the basis of the analysis.

According to an aspect there is provided an ion source comprising:

one or more heating devices configured to heat a sample to cause analyte to be released from the sample; and one or more charged particle sources configured to produce charged particles downstream of the sample;

wherein the ion source is configured such that at least some analyte released from the sample is ionized by the charged particles.

The charged particles may comprise charged droplets.

The charged droplets may comprise charged solvent droplets.

The charged droplets may comprise (i) water; (ii) formic acid and/or another organic acid; (iii) acetonitrile; and/or (iv) methanol.

The one or more charged particle sources may comprise one or more impactor targets.

The ion source may be configured such that droplets are caused to impact upon the one or more impactor targets.

The one or more charged particle sources may be configured to produce charged particles downstream of the sample by causing droplets to impact upon an impactor target so as to produce the charged droplets and/or so as to aid the production of charged droplets and/or ions.

The one or more impactor targets may be located downstream of the sample.

The ion source may comprise a sprayer configured to emit droplets from an outlet of the sprayer.

The outlet of the sprayer may be located downstream of the sample.

The one or more charged particle sources may be configured to produce charged particles downstream of the sample by emitting the charged droplets from the outlet of the sprayer.

The outlet of the sprayer may be located downstream of the sample.

The one or more charged particle sources may comprises a liquid supply configured to provide liquid to the sprayer with a flow rate of (i) ≥100 μL/min; (ii) ≥200 μL/min; (iii) ≥300 μL/min; (iv) ≥400 μL/min; or (v) ≥500 μL/min.

The charged particles may comprise a plasma.

The charged particles may comprise an electric discharge such as a corona discharge.

The one or more heating devices may comprise a heated gas outlet configured to emit a heated gas.

The sample may be located downstream of the heated gas outlet.

The ion source may be configured such that the heated gas urges at least some of the analyte released from the sample downstream of the sample so that at least some of the analyte is ionized by the charged particles.

The one or more heating devices may comprise a flash vaporization device.

The ion source may be configured to heat the sample, produce charged particles downstream of the sample, and use the charged particles to ionize at least some of the analyte in a first mode of operation.

The ion source may be configured in a second different mode of operation to produce charged particles upstream of the sample, and to use the charged particles to ionize at least some of the sample so as to produce analyte ions.

The ion source may comprise an ambient and/or atmospheric pressure ion source.

According to an aspect there is provided an analytical instrument comprising the ion source as described above and an ion inlet.

The sprayer outlet may be located at a first distance $x_1$ in a first direction from the ion inlet.

The sample may be located at a second distance $x_2$ in the first direction from the ion inlet.

The second distance $x_2$ may be larger than the first distance $x_1$.

The sprayer outlet may be located at a first distance $x_1$ in a first direction from the ion inlet.

The sample may be located at a second distance $x_2$ in the first direction from the ion inlet.

The second distance $x_2$ may be less than the first distance $x_1$.

According to an aspect there is provided an analytical instrument comprising:

the ion source as described above;

an analyser configured to analyse the analyte ions; and processing circuitry configured to determine whether the analyte comprises an involatile substance on the basis of the analysis.

According to an aspect there is provided an analytical instrument comprising:

an ion source configured to ionize a sample so as to produce analyte ions using charged droplets;

an analyser configured to analyse the analyte ions; and processing circuitry configured to determine whether the sample comprises an involatile substance on the basis of the analysis.

The processing circuitry may be configured to determine whether the sample comprises an involatile explosive on the basis of the analysis.

BRIEF DESCRIPTION OF THE DRAWINGS

Various embodiments will now be described, by way of example only, and with reference to the accompanying drawings in which.

DETAILED DESCRIPTION

Figure 1A:
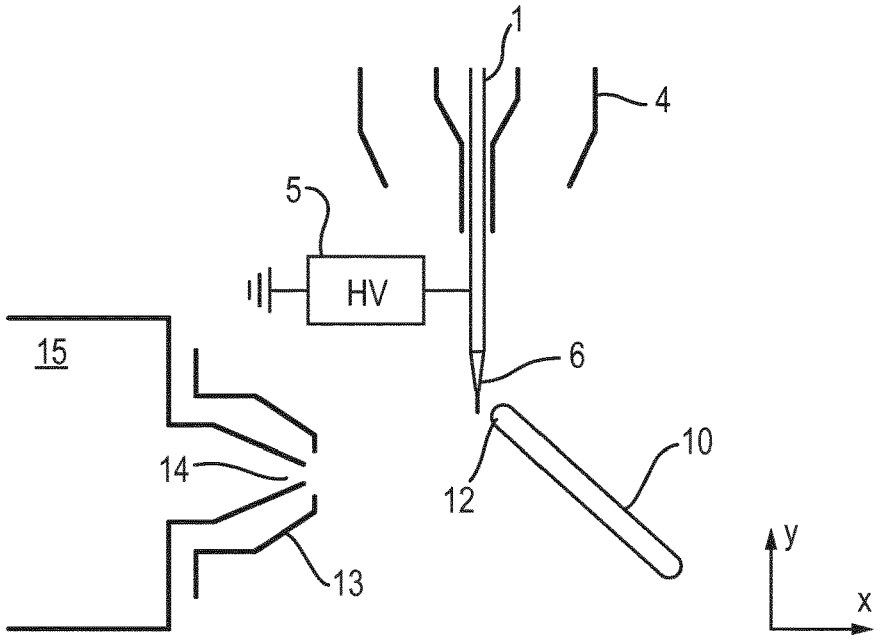
Fig. 1(a) Prior art
FIG. 1A shows schematically a Helium Plasma Ionization (HePI) ion source.

Various embodiments are directed to a method of ionizing a sample in which a sample is heated so that analyte is released from the sample, charged particles are produced downstream of the sample, and the charged particles are used to ionize the analyte released from the sample so as to produce analyte ions.

The sample may comprise any suitable sample. The sample may comprise at least part of a sample of interest, i.e. for which it is desired to determine the chemical composition of the sample and/or whether the sample comprises a particular category of substance.

In particular embodiments, the sample comprises one or more involatile and/or thermally labile substances. As will be described in more detail below, the Applicants have found that the ionization technique according to various embodiments is particularly suited to the ionization of involatile and/or thermally labile substances.

In various particular embodiments, the sample may comprise one or more involatile explosive substances, one or more involatile organic substances, one or more hydrocarbons such as oil, fuel additives, etc.

However, the sample may more generally comprise any suitable sample. For example, the sample may additionally or alternatively comprise one or more volatile substances.

In various embodiments, the sample is provided on and/or in a sample target. In these embodiments at least part or all of the sample target (i.e. at least the part of the sample target on and/or in which the sample is provided) may be provided upstream of the (source of the) charged particles (e.g. charged droplets).

The sample target may comprise any suitable sample target, such as a rod, a pin, a needle shaped target, a cone shaped target, a grid or a mesh target, or a swab. The sample target may have a size (e.g. diameter), for example, of: (i) <1 mm; (ii) 1 to 1.5 mm; (iii) 1.5 to 2 mm; (iv) 2 to 3 mm; (v) 3 to 4 mm; (vi) 4 to 5 mm; or (vii) >5 mm. The sample target may be formed from any suitable material, such as glass, stainless steel, metal, gold, a non-metallic substance, a semiconductor, a metal or other substance with a carbide coating, an insulator or a ceramic, an absorbent material such as cotton, etc.

In various particular embodiments, the sample target comprises a glass rod having the sample deposited thereon. In various other particular embodiments, the sample target comprises a swab, e.g. a cotton swab, having the sample deposited thereon and/or therein.

The sample may be deposited on the sample target in any suitable manner. The sample may, for example, be deposited directly onto the sample target, and/or the sample target may be wiped against a surface of a sample, e.g. swabbed, so that a portion of the sample is retained on the sample target.

However, it is not necessary for the sample to be deposited on (or in) a separate target, and (where appropriate) the sample may be provided directly to the ion source (without a sample target).

The sample may be heated in any suitable manner. The sample should be heated so that at least some analyte of the sample is released from the sample, e.g. so that analyte molecules of the sample are desorbed and/or evaporated from the sample.

According to various embodiments, the sample is heated to a temperature of (i) ≥100° C.; (ii) ≥150° C.; (iii) ≥200° C.; (iv) ≥250° C.; (v) ≥300° C.; (vi) ≥350° C.; (vii) ≥400° C.; (viii) ≥500° C.; (viii) ≥600° C.; (viii) ≥700° C.; or (viii) ≥800° C.

The temperate of the sample may be fixed, e.g. at a particular temperature, and/or the temperature of the sample may be varied in time. Where the temperature of the sample is varied in time, its temperature may be increased, decreased, progressively increased, progressively decreased, increased in a stepped, linear or non-linear manner, and/or decreased in a stepped, linear or non-linear manner, etc.

The sample may be heated directly, e.g. using a heating device (heater) coupled (directly) to the sample and/or to the sample target.

For example, it would be possible for the sample and/or sample target (e.g. cotton swab) to be located within a desorption oven, e.g. a swab desorption oven. In this case, desorbed sample from the swab may be delivered to the ionisation source e.g. via the carrier gas outlet of the swab desorption oven.

However, according to various particular embodiments, the sample is heated by a heated gas flow. In this case, a gas flow may be heated (directly) using a heating device (heater), and then the heated gas flow may be provided to the sample, e.g. by locating the sample and/or the sample target in the heated gas flow, so as to heat the sample. As will be described in more detail below, this represents a particularly convenient and straightforward technique for heating the sample.

Suitable heating devices for heating the sample, the sample target and/or the gas flow include for example: (i) one or more infra-red heaters; (ii) one or more combustion heaters; (iii) one or more laser heaters; and/or (iv) one or more electrical heaters. According to various embodiments, the heater may be set to a temperature of (i) ≥100° C.; (ii) ≥150° C.; (iii) ≥200° C.; (iv) ≥250° C.; (v) ≥300° C.; (vi) ≥350° C.; (vii) ≥400° C.; (viii) ≥500° C.; (viii) ≥600° C.; (viii) ≥700° C.; or (viii) ≥800° C.

It would also be possible, if desired, for the ion source to comprise one or more cooling devices such as: (i) one or more circulatory water or solvent cooling devices; (ii) one or more air cooling devices; (iii) one or more heat pump/refrigerated cooling device; (iv) one or more thermoelectric (Peltier) cooling devices; (v) one or more non-cyclic cooling devices; and/or (vi) one or more liquid gas evaporation cooling devices. The cooling device(s) may be used, e.g. in conjunction with the heating device(s) to control the temperature of sample.

The heated gas flow may comprise any suitable gas, such as nitrogen, air, carbon dioxide and/or ammonia.

The heated gas flow may be emitted from one or more heated gas outlets of the ion source, e.g. where the sample (and the sample target) is provided downstream of the one or more heated gas outlets.

According to various embodiments, the sample (and the sample target) is located a distance: (i) >5 mm; (ii) ≤5 mm; (iii) ≤4 mm; (iv) ≤3 mm; (v) ≤2 mm; or (vi) ≤1 mm (downstream) from the one or more heated gas outlets. The closer the sample is to the one or more heated gas outlets, the greater the effect of heating by the heated gas flow emitted from the one or more heated gas outlets. It will be appreciated that placing the sample (and the sample target) in close proximity with a heated gas outlet represents a significant departure from the arrangement described in WO 2012/143737 and WO 2015/128661.

The one or more heated gas outlets may have any suitable form. As will be described in more detail below, in various particular embodiments the one or more heated gas outlets comprise an annular heated gas outlet, e.g. that may at least partially surround the source of the charged particles, and that may be configured to provide heat to the charged particles. The one or more heated gas outlets may comprise, for example, an annular desolvation heater that at least partially surrounds a sprayer device that is configured to emit a spray of droplets (e.g. where the annular desolvation heater is configured to cause desolvation of the droplets).

According to various embodiments, the analyte (molecules) released from the sample is urged and/or carried by, e.g. entrained in, the heated gas flow so as to be urged and/or carried downstream from the sample and/or the sample target, i.e. so as to then interact with and be ionized by the charged particles.

At least some of the analyte may interact with the charged particles while being carried, e.g. entrained in, the heated gas flow, i.e. in the gas phase. Additionally or alternatively, at least some of the analyte may adsorb onto one or more surfaces of the ion source downstream from the sample and/or the sample target, and the analyte may then interact with the charged particles when adsorbed onto the one or more surfaces, e.g. by the charged particles impacting upon the one or more surfaces.

The charged particles that are produced downstream of the sample (and the sample target) and that are used to ionize the analyte may comprise any suitable charged particles and may be produced in any suitable manner. The ion source may comprise a charged particle source, e.g. comprising a charged particle production region and/or a charged particle outlet arranged downstream of the sample.

In various particular embodiments, the charged particles comprise charged droplets, e.g. charged solvent droplets. Thus, in various embodiments charged (solvent) droplets are produced downstream of the sample and are used to ionize at least some of the analyte released from the sample. The Applicants have found that such solvent-mediated techniques are particularly suitable for the ionization of thermally labile and/or involatile substances.

The charged (solvent) droplets may comprise a spray or stream of charged (solvent) droplets. In these embodiments, some or all of the individual droplets of the spray or stream of droplets may be charged (and some may be neutral), i.e. so long as the spray or stream of droplets has a net charge.

In various embodiments, the charged solvent droplets may comprise charged droplets of (i) water; (ii) acetonitrile; (iii) methanol; and/or (iv) formic acid and/or another organic acid. Other possible solvents include ethanol, propanol and isopropanol. The solvent may comprise any suitable non-acidic or acidic additives such as acetic acid, ammonium hydroxide, ammonium formate, ammonium acetate, etc. Other solvents and/or additives would be possible.

In a particular embodiment, the charged droplets comprise charged droplets of aqueous formic and/or other organic acid. As will be described in more detail below, the Applicants have found that charged droplets of aqueous formic and/or other organic acid are particularly suited for ionizing molecules of thermally labile and/or involatile substances such as involatile explosives released from a sample due to heating.

In these embodiments, the aqueous formic and/or other organic acid may comprise, for example, (i) <0.05% formic and/or other organic acid; (ii) 0.05-0.1% formic and/or other organic acid; (iii) 0.1-0.2% formic and/or other organic acid; (iv) 0.2-0.3% formic and/or other organic acid; or (v) >0.3% formic and/or other organic acid. Other arrangements would, however, be possible.

The composition of the solvent may be held constant and/or may be altered over time, e.g. in a linear, non-linear and/or stepped manner.

The charged droplets may be produced in any suitable manner. In various embodiments, droplets are emitted from a sprayer device such as a nebuliser. The droplets emitted by the sprayer may (already) be charged (i.e. the charged particle source may comprise a sprayer device such as a nebuliser), or the droplets emitted by the sprayer may be subsequently charged, i.e. downstream from the sprayer.

In these embodiments, the sprayer may have any suitable form. The sprayer should have at least one droplet outlet which emits, in use, the (e.g. spray or stream of) (charged or non-charged) droplets.

In various embodiments, the sprayer (e.g. nebuliser) comprises a first capillary tube and a second capillary tube, e.g. where the second capillary tube at least partially surrounds the first capillary tube (e.g. in a concentric manner or otherwise). A liquid (e.g. solvent) may be passed through the first capillary tube and a (nebuliser) gas may be passed through the second capillary tube. The (liquid) outlet of the first capillary tube and the (gas) outlet of the second capillary tube may be configured so that the gas (i.e. a stream of gas) is provided to the outlet of the first capillary tube.

The arrangement of the capillaries, the flow rate of the liquid and/or the flow rate of the gas may be configured such that a spray of droplets is produced by the sprayer.

The first capillary tube may have an internal diameter of around (i) <100 μm; (ii) 100-120 μm; (iii) 120-140 μm; (iv) 140-160 μm; (v) 160-180 μm; (vi) 180-200 μm; or (vii) >200 μm. The first capillary tube may have an outer diameter of around (i) <180 μm; (ii) 180-200 μm; (iii) 200-220 μm; (iv) 220-240 μm; (v) 240-260 μm; (vi) 260-280 μm; (vii) 280-300 μm; or (viii) >300 μm. The second capillary tube may have an internal diameter of around (i) <280 μm; (ii) 280-300 μm; (iii) 300-320 μm; (iv) 320-340 μm; (v) 340-360 μm; (vi) 360-380 μm; (vii) 380-400 μm; or (viii) >400 μm.

As will be described in more detail below, the Applicants have found that higher solvent flow rates can result in improved ionization efficiency. (However, if the solvent flow rate is too high, the formation of a spray of droplets can be inhibited.) In various embodiments, the liquid (solvent) may be provided to the sprayer, e.g. to the first capillary tube, with a flow rate of (i) <25 μL/min; (ii) 25-50 μL/min; (iii) 50-100 μL/min; (iv) 100-200 μL/min; (v) 200-300 μL/min; (vi) 300-400 μL/min; (vii) 400-500 μL/min; or (viii) >500 μL/min.

In various embodiments, the gas may be provided to the sprayer, e.g. to the second capillary tube, with a flow rate of (i) <100 L/hr; (ii) 100-150 L/hr; (iii) 150-200 L/hr; (iv) 200-250 L/hr; (v) 250-300 L/hr; (vi) 300-350 L/hr; (vii) 350-400 L/hr; or (viii) >400 L/hr. The gas may comprise any suitable nebulising gas such as for example nitrogen.

As described above, the sample may be heated by a heated gas flow e.g. that is emitted from one or more heated gas outlets of the ion source. The one or more heated gas outlets (and the heater) may be separate from the sprayer device. However, as also described above, in various particular embodiments, the one or more heated gas outlets may comprise an (annular) heated gas outlet that at least partially surrounds the sprayer device.

Thus, the sprayer may further comprise a heated gas outlet, e.g. in the form of a third tube that may at least partially surround the second (and first) capillary tube (e.g. in a concentric manner or otherwise). A (desolvation) gas may be passed through the third tube and heated so as to produce the heated (desolvation) gas flow. The (gas) outlet of the third tube may be configured so that the heated gas is provided to the outlet of the first and second capillary tube. The sprayer may be configured such that the heated gas emitted from the heated gas outlet causes desolvation of the droplets emitted from the sprayer. The ion source may also be configured such that the heated gas emitted from the heated gas outlet heats the sample.

The heated (desolvation) gas may be emitted from the heated gas outlet with any suitable flow rate such as (i) <100 L/hr; (ii) 100-200 L/hr; (iii) 200-300 L/hr; (iv) 300-400 L/hr; (v) 400-500 L/hr; (vi) 500-600 L/hr; (vii) 600-700 L/hr; (viii) 700-800 L/hr; or (viii) >800 L/hr.

As described above, in various embodiments, the charged droplets are emitted (directly) from the sprayer (e.g. nebuliser).

In these embodiments, the sample (and a least part or all of the sample target) should be provided upstream of the droplet outlet(s) of the sprayer, e.g. upstream of the (liquid) outlet of the first capillary tube (and of the (gas) outlet of the second capillary tube). In addition, as described above, the sample (and the sample target) should be provided downstream of the heated gas outlet. It will be appreciated that placing the sample (and a least part or all of the sample target) upstream of the droplet outlet (and downstream of the heated gas outlet) represents a significant departure from the arrangements described in WO 2012/143737 and WO 2015/128661.

Thus, in various particular embodiments, the sample (and a least part or all of the sample target) is located between the heated (desolvation) gas outlet and the droplet outlet of the sprayer device (e.g. nebuliser). In these embodiments, the sample may be heated by the heated (desolvation) gas flow emitted from the heated (desolvation) gas outlet so that at least some analyte is released from the sample. Analyte (molecules) may be urged and/or carried by, e.g. entrained in, the heated (desolvation) gas flow so as to be urged and/or carried downstream of the droplet outlet, i.e. so that at least some of the analyte interacts with the charged droplets emitted from the sprayer.

At least some of the analyte may interact with the charged droplets while being carried, e.g. entrained in, the heated gas flow, i.e. in the gas phase. Additionally or alternatively, at least some of the analyte may adsorb onto one or more surfaces of the ion source downstream from the droplet outlet, and the analyte may then interact with the charged droplets when adsorbed onto the one or more surfaces, e.g. by the charged droplets impacting upon the one or more surfaces.

The interaction of the released analyte (e.g. desorbed analyte molecules) with the charged droplets may cause at least some of the analyte to be ionized, i.e. so as to form analyte ions.

As such, in these embodiments, the ionization mechanism may comprise Secondary Electrospray Ionization (SESI).

In these embodiments, in order to cause the droplets emitted by the sprayer to be charged, the first (and/or second) capillary tubes of the sprayer may be provided with a voltage, e.g. from a high voltage (HV) source. As such, the ion source may comprise a voltage source that is configured to apply a voltage to the first (and/or second) capillary tube of the sprayer. Any suitable voltage may be applied to the first (and/or second) capillary tube, such as a voltage of (i) <500 V; (ii) 500 V-1 kV; (iii) 1-2 kV; (iv) 2-3 kV; (v) 3-4 kV; (vi) 4-5 kV; or (vii) >5 kV. The voltage may be positive or negative. A negative voltage is beneficial for the detection of explosives since these analytes typically ionize with greater efficiency in negative ion mode.

As described above, according to various other embodiments, (substantially electrically neutral) droplets may be emitted from the sprayer (e.g. nebuliser), and then the (substantially electrically neutral) droplets may then be charged. In these embodiments, some or all of the individual droplets emitted from the sprayer may be electrically neutral and/or some or all may be charged, i.e. so long as the spray or stream of droplets emitted from the sprayer has a net charge which is nominally neutral. For example, it would be possible for the spray or stream of droplets emitted from the sprayer to comprise both positively charged and negatively charged droplets, e.g. where the net charge of the spray or stream is nominally neutral.

According to various particular embodiments, the first (and/or second) capillary tube of the sprayer is not provided with a voltage, e.g. may be grounded (or may be provided with a suitably low voltage), i.e. so that most or all of the individual droplets emitted from the sprayer are electrically neutral.

The (substantially electrically neutral) droplets emitted from the sprayer may be subsequently charged in any suitable manner. In various particular embodiments, the (substantially electrically neutral) droplets emitted from the sprayer are caused to impact upon one or more impactor targets, i.e. so as to form charged droplets. The droplets impacting upon the one or more impactor targets may also give rise to other charged particles such as ions.

Thus, the ion source may comprise one or more impactor targets located downstream of the sprayer (e.g. nebuliser), and the droplets emitted by the sprayer may be caused to impact the one or more impactor targets, i.e. to cause the droplets to become charged.

In these embodiments, the sample (and at least part or all of the sample target) should be provided upstream of the one or more impactor targets. It will be appreciated that placing the sample (and at least part or all of the sample target) upstream of the impactor target represents a significant departure from the arrangements described in WO 2012/143737 and WO 2015/128661.

In these embodiments, the sample (and at least part or all of the sample target) may be provided downstream of the sprayer outlet(s), e.g. between the sprayer outlet(s) and the impactor target.

Alternatively, the sample (and at least part or all of the sample target) may be provided upstream of the sprayer outlet(s), e.g. upstream of the (liquid) outlet of the first capillary tube (and of the (gas) outlet of the second capillary tube) (but downstream of the heated gas outlet). This allows the sample to be closer to the heated (desolvation) gas outlet, and so increases the heating effect of the heated gas. Thus, the sample (and at least part or all of the sample target) may be located between the heated (desolvation) gas outlet and the droplet outlet of the sprayer device (e.g. nebuliser), i.e. so that the sample is heated by the heated (desolvation) gas flow emitted from the (desolvation) gas outlet so that analyte is released from the sample.

In these embodiments, analyte may be urged and/or carried by, e.g. entrained in, the heated (desolvation) gas flow so as to be urged and/or carried downstream of the one or more impactor targets, i.e. so that the analyte interacts with the charged droplets (and optionally other charged particles such as ions) produced by the one or more impactor targets.

At least some of the analyte may interact with the charged droplets while being carried, e.g. entrained in, the heated gas flow, i.e. in the gas phase. Additionally or alternatively, at least some of the analyte may adsorb onto one or more surfaces of the ion source downstream from the one or more impactor targets, and the analyte may then interact with the charged droplets when adsorbed onto the one or more surfaces, e.g. by the charged droplets impacting upon the one or more surfaces.

The interaction of the released analyte (e.g. desorbed analyte molecules) with the charged droplets (and optionally other charged particles such as ions) produced by the one or more impactor targets may cause at least some of the analyte to be ionized, i.e. so as to form analyte ions.

As such the ionization mechanism according to these embodiments may comprise Ambient Impactor Spray Ionization (AISI).

Where present, the impactor target or targets may have any suitable form. The or each impactor target may comprise, for example, a rod, a pin, a needle shaped target, a cone shaped target, a grid or a mesh target. The or each impactor target may have a size (e.g. diameter), for example, of: (i) <1 mm; (ii) 1 to 1.5 mm; (iii) 1.5 to 2 mm; (iv) 2 to 3 mm; (v) 3 to 4 mm; (vi) 4 to 5 mm; or (vii) >5 mm. The or each impactor target may be formed from any suitable material, such as glass, stainless steel, metal, gold, a non-metallic substance, a semiconductor, a metal or other substance with a carbide coating, a metal with an oxide coating, an insulator or a ceramic, etc.

In various particular embodiments, the or each impactor target is formed from an electrically conductive material.

The one or more impactor targets should be located downstream of the outlet(s) of the sprayer (e.g. nebuliser), i.e. so that at least some of the droplets emitted from the sprayer impact upon the surface of the one or more impactor targets.

The or each impactor target may be located at any suitable distance from the (droplet) outlet of the sprayer. According to various embodiments, the impactor target is located a distance from the (droplet) outlet of the sprayer of: (i) <20 mm; (ii) <19 mm; (iii) <18 mm; (iv) <17 mm; (v) <16 mm; (vi) <15 mm; (vii) <14 mm; (viii) <13 mm; (ix) <12 mm; (x) <11 mm; (xi) <10 mm; (xii) <9 mm; (xiii) <8 mm; (xiv) <7 mm; (xv) <6 mm; (xvi) <5 mm; (xvii) <4 mm; (xviii) <3 mm; or (xix) <2 mm.

In various embodiments, a voltage is applied to the or each impactor target. This can increase the ionization efficiency. As such, the ion source may comprise a voltage source that is configured to apply a voltage to the one or more impactor targets. Any suitable voltage may be applied to the one or more impactor targets According to various embodiments, a voltage of (i) <200 V; (ii) 200-400 V; (iii) 400-600 V; (iv) 600-800 V; (v) 800 V-1 kV; (vi) 1-2 kV; (vii) 2-3 kV; (viii) 3-4 kV; (ix) 4-5 kV; or (x) >5 kV is applied to the one or more impactor targets. The voltage may be positive or negative. A negative voltage is beneficial for the detection of explosives since these analytes typically ionize with greater efficiency in negative ion mode.

Thus, according to various embodiments, (substantially electrically neutral) droplets are emitted from a grounded sprayer and are caused to impact upon one or more impactor targets that are held at a high voltage.

However, it would also be possible for charged droplets to be emitted from a sprayer (e.g. that is held at a high voltage as described above) and for the charged droplets to impact upon one or more impactor targets. In this case, the one or more impactor targets may be grounded or may be held at a high voltage (e.g. as described above, mutatis mutandi). In this case, the one or more impactor targets have the effect of enhancing charged droplet break up and ion formation from the charged droplets produced by the sprayer.

It will be appreciated that the ionization mechanism according to various particular embodiments comprises a solvent-mediated ionization mechanism such as Secondary Electrospray Ionization (SESI) or Ambient Impactor Spray Ionization (AISI).

Although as described above in various particular embodiments the charged particles comprise charged droplets, it would also be possible for the charged particles to comprise a plasma. Thus, in various embodiments a plasma is produced downstream of the sample (and downstream of at least part or all of the sample target) and is used to ionize at least some of the analyte released from the sample.

The plasma may be produced in any suitable manner. In various embodiments, the plasma is produced by a plasma source i.e. that produces, in use, a plasma (i.e. the charged particle source comprises a plasma source).

In various embodiments, the plasma source comprises a capillary tube, where a gas such as helium may be passed through the capillary tube, and where the capillary tube is provided with a voltage, e.g. from a high voltage (HV) source, i.e. such that a (helium) plasma is formed downstream of the capillary tube outlet. As such, the ion source may comprise a voltage source that is configured to apply a voltage to the capillary tube of the plasma source. Any suitable voltage may be applied to the first capillary tube such as a voltage of (i) <500 V; (ii) 500 V-1 kV; (iii) 1-2 kV; (iv) 2-3 kV; (v) 3-4 kV; (vi) 4-5 kV; or (vii) >5 kV. The voltage may be positive or negative.

The (helium) gas may be provided to the capillary tube with any suitable flow rate such as (i) <25 mL/min; (ii) 25-50 mL/min; (iii) 50-100 mL/min; (iv) 100-150 L/min; (v) 150-200 mL/min; (vi) 200-250 mL/min; (vii) 250-300 mL/min; or (viii) >300 mL/min.

As described above, the sample may be heated by a heated gas flow e.g. that is emitted from one or more heated gas outlets of the ion source. The one or more heated gas outlets (and the heater) may be separate from the plasma source. However, in various embodiments, the one or more heated gas outlets may comprise an (annular) heated gas outlet that at least partially surrounds the capillary of the plasma source.

Thus, the plasma source may further comprise a heated gas outlet, e.g. in the form of a further tube that may at least partially surround the capillary tube (e.g. in a concentric manner or otherwise). A gas may be passed through the further tube and heated so as to produce the heated gas flow. The (gas) outlet of the further tube may be configured so that the heated gas is provided to the outlet of the capillary tube.

In these embodiments, the heated gas may comprise any suitable gas such as for example nitrogen. The heated gas may be emitted from the heated gas outlet with any suitable flow rate such as (i) <100 L/hr; (ii) 100-200 L/hr; (iii) 200-300 L/hr; (iv) 300-400 L/hr; (v) 400-500 L/hr; (vi) 500-600 L/hr; (vii) 600-700 L/hr; (viii) 700-800 L/hr; or (viii) >800 L/hr.

In these embodiments, the sample (and at least part or all of the sample target) should be provided upstream of the plasma source outlet, e.g. upstream of the outlet of the capillary tube. Thus, in various embodiments, the sample (and at least part or all of the sample target) is located between the heated gas outlet and the plasma outlet of a plasma source, i.e. so that the sample is heated by the heated gas flow emitted from the gas outlet so that analyte is released from the sample.

Analyte may be urged and/or carried by, e.g. entrained in, the heated gas flow so as to be urged and/or carried downstream of the plasma outlet, i.e. so that the analyte interacts with the plasma emitted from the plasma outlet. At least some of the analyte may interact with the plasma while being carried, e.g. entrained in, the heated gas flow, i.e. in the gas phase. Additionally or alternatively, at least some of the analyte may adsorb onto one or more surfaces of the ion source downstream from the plasma outlet, and the analyte may then interact with the plasma when adsorbed onto the one or more surfaces, e.g. by the plasma impacting upon the one or more surfaces.

In these embodiments, the interaction of the released analyte (e.g. desorbed analyte molecules) with the plasma may cause at least some of the analyte to be ionized, i.e. so as to form analyte ions.

As such in these embodiments, the ionization mechanism may comprise Helium Plasma Ionization (HePI).

In various further embodiments the charged particles comprise an electric discharge such as a corona discharge. Thus, in various embodiments an electric discharge is produced downstream of the sample (and downstream of at least part or all of the sample target) and is used to ionize at least some of the analyte released from the sample.

The electric discharge may be produced in any suitable manner. In various embodiments, the electric discharge is produced by an electric discharge source that may produce, in use, an electric discharge such as a corona discharge (the charged particle source may comprise an electric discharge source such as a corona discharge source).

In various embodiments, the electric discharge source comprises a pin (or needle), which is provided with a voltage, for example from a high voltage (HV) source, such that an electric discharge such as a corona discharge may be formed. As such, the ion source may comprise a voltage source that is configured to apply a voltage to the pin (needle) of the electric discharge source. Any suitable voltage may be applied to the pin such as a voltage of (i) <500 V; (ii) 500 V-1 kV; (iii) 1-2 kV; (iv) 2-3 kV; (v) 3-4 kV; (vi) 4-5 kV; or (vii) >5 kV. The voltage may be positive or negative.

As described above, the sample may be heated by a heated gas flow, for example that is emitted from one or more heated gas outlets of the ion source. In these embodiments, the one or more heated gas outlets (and the heater) may be separate from the electric discharge source. However, it would also be possible for the one or more heated gas outlets to comprise an (annular) heated gas outlet, for example that at least partially surrounds the pin of the electric discharge source in a corresponding manner to that described above.

In these embodiments, the heated gas may comprise any suitable gas such as for example air or nitrogen. The heated gas may be emitted from the heated gas outlet with any suitable flow rate such as (i) <1 L/hr; (ii) 1-2 L/hr; (iii) 2-3 L/hr; (iv) 3-4 L/hr; (v) 4-5 L/hr; (vi) 5-6 L/hr; (vii) 6-7 L/hr; (viii) 7-8 L/hr; or (viii) >8 L/hr.

In these embodiments, the sample (and at least part or all of the sample target) should be provided upstream of the electric discharge source, such as upstream of the pin of the electric discharge source. Thus, in various embodiments, the sample (and at least part or all of the sample target) is located between the heated gas outlet and the pin of an electric discharge source, so that the sample may be heated by the heated gas flow emitted from the gas outlet so that analyte is released from the sample.

Analyte may be urged and/or carried by, for example entrained in, the heated gas flow so as to be urged and/or carried downstream of the electric discharge source, so that the analyte may interact with the electric discharge (corona discharge) produced by the electric discharge source. At least some of the analyte may interact with the electric discharge while being carried, for example entrained in, the heated gas flow, and/or while in the gas phase.

In these embodiments, the interaction of the released analyte (such as desorbed analyte molecules) with the electric discharge (corona discharge) may cause at least some of the analyte to be ionized, so as to form analyte ions.

As such in these embodiments, the ionization mechanism may comprise Corona Discharge Ionization (CDI).

As described above, charged particles (e.g. charged droplets) are produced downstream of the sample and are used to ionize at least some of the analyte released from the sample so as to produce analyte ions.

In various particular embodiments, the analyte ions are then analysed. This may be done in any suitable manner.

According to various embodiments, at least some of the analyte ions are introduced into an analytical instrument such as a mass and/or ion mobility spectrometer. This may be done via an ion inlet (e.g. atmospheric interface) of the analytical instrument.

According to various embodiments, the ion inlet may comprise an ion orifice, an ion inlet cone, an ion inlet capillary, an ion inlet heated capillary, an ion tunnel, an ion mobility spectrometer or separator, a differential ion mobility spectrometer, a Field Asymmetric Ion Mobility Spectrometer ("FAIMS") device or other ion inlet. The ion inlet device may be maintained at or close to ground potential.

According to various embodiments, the ion inlet is located downstream of the ion source, i.e. downstream of the of charged particle source (e.g. downstream of the sprayer (nebuliser) outlet, downstream of the one or more impactor targets, and/or downstream of the plasma source).

According to various embodiments, the sprayer droplet outlet and/or the plasma source is located at a first distance $x_1$ in a first direction from the ion inlet. The first (x-) direction may be parallel to a central axis of the ion inlet. The first distance $x_1$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to various embodiments, the sample is located at a second distance $x_2$ in the first direction from the ion inlet. The second distance $x_2$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to various embodiments, the one or more impactor targets is located at a third distance $x_3$ in the first direction from the ion inlet. The third distance $x_3$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to various embodiments, the sprayer droplet outlet and/or the plasma source may be located at a fourth distance $y_1$ in a second direction from the ion inlet. The second direction may be orthogonal to the first direction. The fourth distance $y_1$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to various embodiments, the sample is also located at a fifth distance $y_2$ in the second direction from the ion inlet. The fifth distance $y_2$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to various embodiments, the one or more impactor targets is also located at a sixth distance $y_3$ in the second direction from the ion inlet. The sixth distance $y_2$ may be selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

As described above, according to various embodiments, the sample is located upstream of the charged particle source (e.g. the sprayer droplet outlet, the one or more impactor targets, and/or the plasma source). Where one or more impactor targets are present, this may be achieved by arranging the sixth distance $y_3$ to be smaller than the fifth distance $y_2$ ($y_2>y_3$). However, according to various particular embodiments, this is achieved by arranging the fourth distance $y_1$ to be smaller than the fifth distance $y_2$. Thus, according to various embodiments, $y_2>y_1$.

In contrast, the first distance $x_1$ may be either larger than or smaller than the second distance $x_2$ and/or the third distance $x_3$.

However, in various particular embodiments where, as described above, the ion source comprises an impactor target, e.g. where the ion source comprises an Ambient Impactor Spray Ionization (AISI) ion source, then the first distance $x_1$ (and the third distance $x_3$) may be smaller than the second distance $x_2$, i.e. the sample may be located further away in the first (x-) direction from the ion inlet than the sprayer droplet outlet (and the impactor target). In addition, the third distance $x_3$ may be smaller than the first distance $x_1$, i.e. $x_3<x_1$ (although it would be possible for $x_3=x_1$ or $x_3>x_1$).

The Applicants have found that locating the sample further from the ion inlet in the first (x-) direction than the sprayer droplet outlet and locating the impactor target closer to the ion inlet in the first (x-) direction than the sprayer droplet outlet improves the proportion of analyte ions that are introduced to the analytical instrument via the ion inlet. This is due to a "steering" or Coanda effect of the heated (and/or nebuliser) gas as it flows past the impactor target and towards the ion inlet.

Thus, in various embodiments, the sprayer droplet outlet is located at a first distance $x_1$ in the first direction from the ion inlet, the sample is located at a second distance $x_2$ in the first direction from the ion inlet (and the impactor target is located at a third distance $x_3$ in the first direction from the ion inlet), where $x_2>x_1$ (and $x_2>x_3$). It would however, be possible for $x_2<x_1$ (and $x_2<x_3$).

In various particular embodiments where, as described above, the ion source comprises a sprayer configured to (directly) emit charged droplets, e.g. where the ion source comprises a Secondary Electrospray Ionization (SESI) ion source, then then the first distance $x_1$ may be greater than the second distance $x_2$, i.e. the sample may be located closer in the first (x-) direction to the ion inlet than the sprayer droplet outlet (i.e. than the outlet of the first capillary tube).

In this regard, the Applicants have found that locating the sample closer to the ion inlet in the first (x-) direction than the sprayer droplet outlet improves the proportion of analyte ions that are introduced to the analytical instrument via the ion inlet. This is believed to be because in this arrangement, the analyte and/or analyte ions need not traverse the spray of charged droplets in order to arrive at the ion inlet.

Thus, in various embodiments, the sprayer droplet outlet (i.e. the outlet of the first capillary tube) is located at a first distance $x_1$ in the first direction from the ion inlet, the sample is located at a third distance $x_2$ in the first direction from the ion inlet, where $x_2<x_1$. It would however, be possible for $x_2>x_1$.

Once at least some of the analyte ions are introduced into the analytical instrument, the analytical instrument may analyse the analyte ions in any suitable manner. According to various embodiments, the analytical instrument is configured to analyse the ions so as to produce mass and/or ion mobility spectral data.

To do this, analyte ions introduced to the analytical instrument via the ion inlet may be passed through one or more subsequent stages of the analytical instrument, and e.g. subjected to one or more of: separation and/or filtering using a separation and/or filtering device, fragmentation or reaction using a collision, reaction or fragmentation device, and analysis using an analyser.

The analyte ions may be (directly) analysed, and/or ions derived from the analyte ions may be analysed. For example, some or all of the analyte ions may be fragmented or reacted so as to produce product ions, e.g. using a collision, reaction or fragmentation device, and these product ions (or ions derived from these product ions) may then be analysed.

Suitable collision, fragmentation or reaction cells include, for example: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and/or (xxix) an Electron Ionization Dissociation ("EID") fragmentation device.

Some or all of the analyte ions or ions derived from the analyte ions may be filtered, e.g. using a mass filter. Suitable mass filters include, for example: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and/or (viii) a Wien filter.

According to various embodiments, the analyte ions or ions derived from the analyte ions are mass analysed, e.g. using a mass analyser, i.e. so as to determine their mass to charge ratio. As such, the analytical instrument may be configured to produce one or more mass spectra.

Suitable mass analysers include, for example: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and/or (xiv) a linear acceleration Time of Flight mass analyser.

Additionally or alternatively, the analyte ions or ions derived from the analyte ions may be analysed using an ion mobility separation device and/or a Field Asymmetric Ion Mobility Spectrometer (FAIMS) device. As such, the analytical instrument may be configured to produce one or more ion mobility or FAIMS spectra.

The analytical instrument may additionally or alternatively be configured to produce one or more mass-to-charge ratio/ion mobility or FAIMS data sets.

The analytical instrument may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

According to various embodiments, the mass and/or ion mobility spectral data is assessed to identify one or more properties of the sample. According to various embodiments, a determination is made as to whether (or not) the sample comprises a particular involatile and/or thermally labile substance of interest (such as for example one or more involatile explosive substances of interest, one or more involatile organic substances of interest, one or more hydrocarbons of interest such as oil, fuel additives, etc.) on the basis of the analysis, e.g. on the basis of the mass and/or ion mobility spectral data. This may involve, e.g. comparing the mass and/or ion mobility spectral data with known data, e.g. stored in a library, or otherwise.

It will accordingly be appreciated that the ion source according to various embodiments can be used for (and is particularly suited for) the detection of thermally labile and/or involatile substance such as involatile (or other) explosives, e.g. for the rapid examination of acquired samples that may contain trace levels of explosives. The ion source according to various embodiments may, however, be used for a variety of other applications.

The ion source according to various embodiments comprises an ambient ionization ion source, i.e. where the source is at least partially open to the environment. This beneficially means that it is not necessary to maintain the sample under vacuum. Thus, the ionization may be performed at ambient and/or atmospheric pressure and/or conditions.

The ion source according to various embodiments is advantageous, e.g. compared with conventional ambient ionization sources that use electrical discharge. This is because conventional electrical discharge sources tend to favour volatile analytes and can be ineffective for the ionization of involatile and thermally labile samples. This volatility limitation also applies to radioactive and photoionization sources such as radioactive Ni-63 ion sources, Dielectric Barrier Discharge (DBD) ion sources, and photoionization ion sources.

In contrast, the ambient ionization source e.g. secondary electrospray ionization (SESI) or ambient impactor spray ionization (AISI) ion source, according to various embodiments can efficiently ionize involatile and thermally labile analytes. The ion source can also be optimized for specific target analytes, e.g. by the addition of chemical modifiers to the solvent.

Although as described above, in various embodiments the charged particles (e.g. charged droplets) are produced downstream of the sample, it would be possible in a different mode of operation to position the sample such that the charged particles (e.g. charged droplets) are produced upstream of the sample. This alternative mode of operation may be used, for example, when it is desired to ionize samples comprising relatively volatile substances. In this way the ion source according to various embodiments can be used to efficiently ionized both volatile and involatile substances.

In order to demonstrate the effectiveness of the ion source according to various embodiments, the detection efficiency of a discharge-based source, namely a helium plasma ionization (HePI) source, and an ambient impactor spray source in accordance with various embodiments was investigated for the ambient mass spectral analysis of Trinitrotoluene (TNT), RDX and HMX. TNT is a relatively volatile explosive (melting point (MP) 80° C.) that became popular at the start of the twentieth century due to its stability and safe handling characteristics. Although it is still widely used today, it was replaced as a military explosive in the mid-twentieth century by the more potent involatile explosives RDX (MP 206° C.) and HMX (MP 280° C.).

A typical HePI source is shown schematically in FIG. 1A. The apparatus is typically surrounded by a grounded metallic enclosure (not shown in FIG. 1A) that includes an opening or entrance that is open to the atmospheric pressure environment, e.g. of the laboratory. In use, a sample or sample rod 10 that is to be presented for ionization is passed through this opening, i.e. for analysis.

A flow of helium gas is passed through a stainless steel capillary 1 which typically has an internal diameter of around 130 μm. Pressurizing the capillary 1 with 30 psig (~200 kPa) of He creates a gas flow rate of typically around 160 mL/min. A high voltage power supply 5 is used to apply a voltage of around −2.5 kV to the capillary 1 which creates a negative ion discharge region 6 at the capillary tip. The capillary 1 is surrounded by an annular heater 4 which directs a flow of hot nitrogen gas towards the discharge 6 at a flow rate of typically around 500 L/hr.

In use, a sample is applied to the tip 12 of the glass sample rod 10 and the sample is positioned around 1-2 mm to the right hand side (i.e. in the positive x-direction) of the tip of the discharge region 6.

The discharge region 6 is located approximately 3 mm in front of (i.e. in the positive x-direction) and 5 mm above (i.e. in the positive y-direction) the circular aperture at the tip of an ion inlet cone 14. Sample ions that are created by the discharge 6 then enter the first vacuum region 15 of analytical instrument (e.g. mass spectrometer) through the ion inlet cone 14. Nitrogen gas may be flowed through the annular nozzle 13 at a typical flow rate of around 150 L/hr.

Figure 1B:
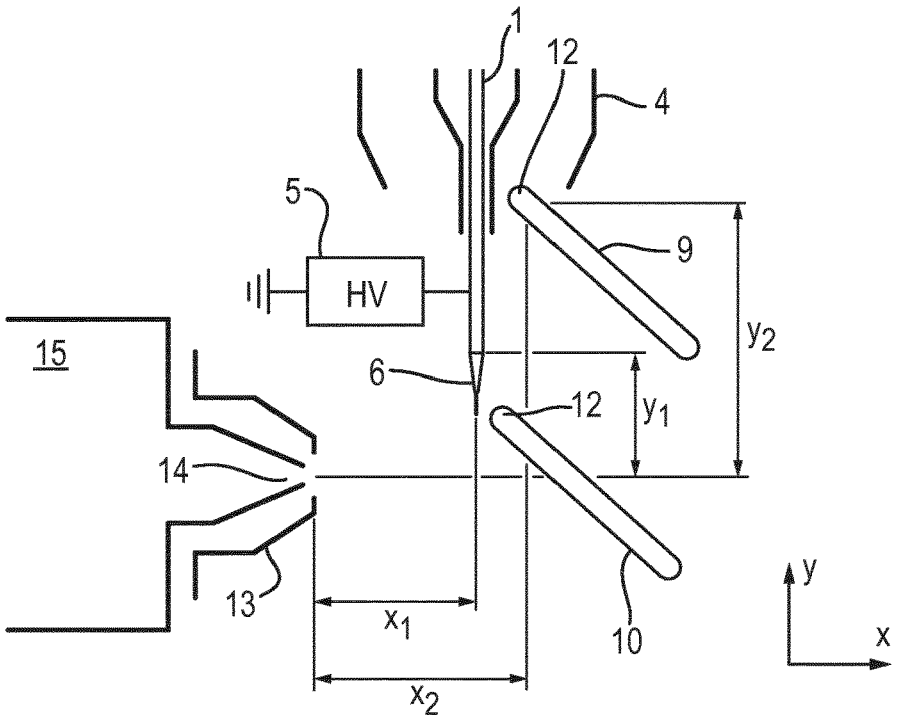
FIG. 1B shows schematically a Helium Plasma Ionization (HePI) ion source in accordance with various embodiments.

FIG. 1B shows a HePI source in accordance with various embodiments. As can be seen from FIG. 1B, the HePI source of FIG. 1B is similar to the HePI source of FIG. 1A, except that the glass sample rod 9 may be positioned such that the sample is located close to or at the outlet of the heater 4. This allows the sample to be heated, e.g. so that analyte ions are desorbed from the sample rod 9.

Figure 2:
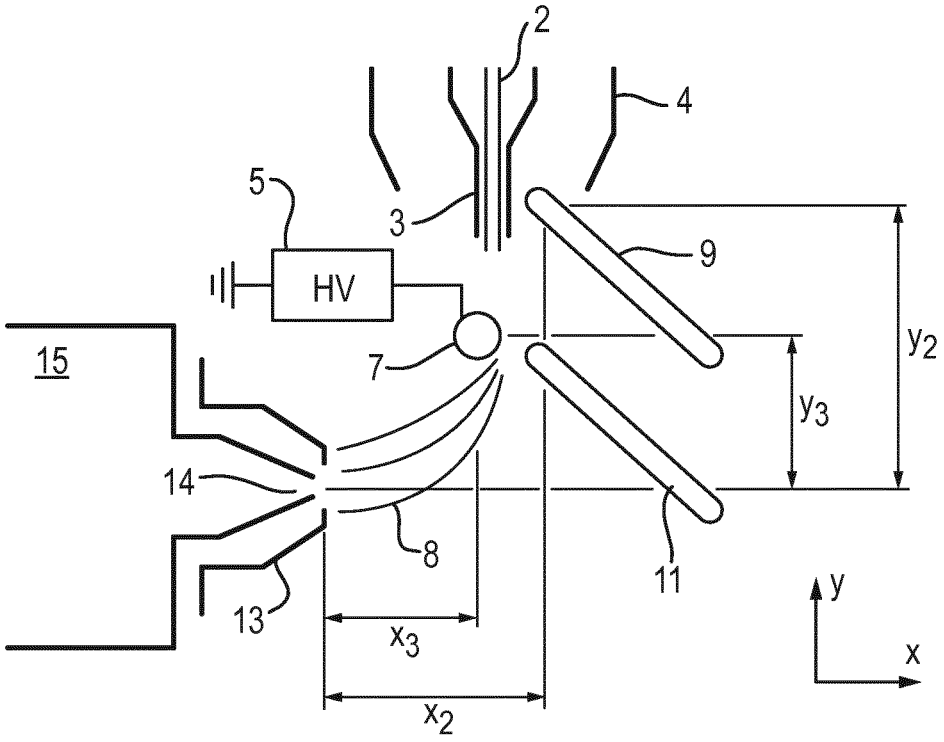
FIG. 2 shows schematically an Ambient Impactor Spray Ionization (AISI) ion source in accordance with various embodiments.

FIG. 2 schematically illustrates an ambient impactor spray ionization (AISI) source in accordance with various embodiments. In the embodiment depicted in FIG. 2, a flow of solvent is passed through a grounded, stainless steel capillary 2 with an internal diameter of around 130 μm and an outer diameter of around 220 μm. The liquid capillary 2 is surrounded by a concentric nebulizer capillary 3 which has an internal diameter of around 330 μm. The nebulizer capillary 3 is pressurized with nitrogen to around 100 psig (~700 kPa) which creates a gas flow of around 200 L/hr.

The resulting high velocity spray is directed at a cylindrical, stainless steel impactor target 7 such that the point of impact of the droplet beam is on the upper right hand quadrant of the target 7, i.e. off-axis or off-centre. This asymmetric geometry leads to Coanda flow at the target 7 which results in gas streamlines 8 that are directed towards the ion inlet cone 14 of the analytical instrument. The impactor target 7 may have a diameter of around 1.6 mm.

In this arrangement, the distance between the nebulizer capillary 3 and the surface of the impactor target 7 is around 3 mm. Furthermore, the target is positioned 5 mm in front of (in the positive x-direction) and 7 mm above (in the positive y-direction) the circular aperture at the tip of the ion inlet cone 14.

In this arrangement, a sample can be introduced into the ion source via a glass rod which may be positioned either a first position at the exit of the heater (i.e. sample rod 9 in FIG. 2), or a second position downstream from the impactor target 7 (i.e. sample rod 11 in FIG. 2). The first sample rod position 9 can be used for involatile analytes, and the second sample rod position 11 can be used for volatile analytes.

Evaporated sample is ionized by the ions and charged droplets that emanate from the target 7 that is connected to a high voltage power supply 5 and is held at a potential of around −1.0 kV. A negative high voltage bias is beneficial for the detection of explosives since these analytes ionize with greater efficiency in negative ion mode. However, it would be possible to use a positive voltage, if desired.

To compare the detection efficiency of TNT, RDX and HMX by HePI and AISI ionization, samples were individually diluted to a concentration of 1 ng/μL in methanol. 2 μL of one sample was deposited onto the rounded tip of a 1.9 mm diameter glass rod prior to immediate insertion into the ion source without a pause for sample drying. Unless otherwise stated, all samples were analysed on a high sensitivity, triple quadrupole mass spectrometer instrument that was operated in full scan mass spectrometry mode (scan range=50-450 Da, scan time=0.5 s).

In order to illustrate the comparative difficulty in ionizing ambient samples with significantly different volatilities, FIG. 3 shows typical full scan mass spectra obtained for the ambient ionization of a few nanograms of TNT and HMX using a HePI source. Here, the annular heater was set to 600° C. which produces a nitrogen gas temperature of typically 250° C. in the region that surrounds the helium discharge. For both samples, the glass rod tip was located at the exit of the annular heater (i.e. rod 9 in FIG. 1B).

Figure 3A:
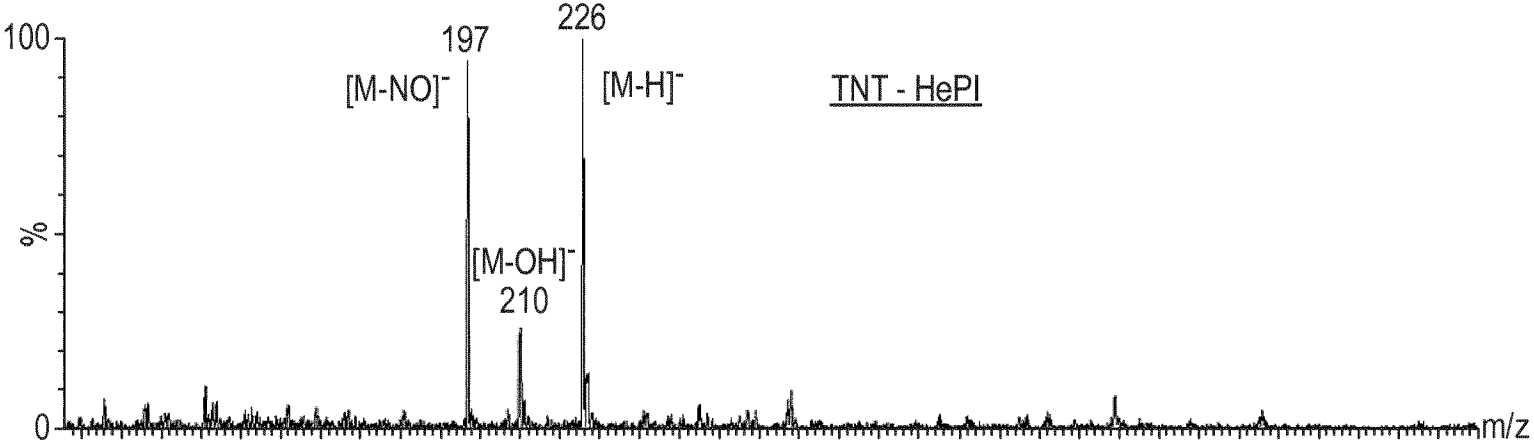
FIG. 3A shows a mass spectrum of a TNT sample obtained using a Helium Plasma Ionization (HePI) ion source.
Figure 3B:
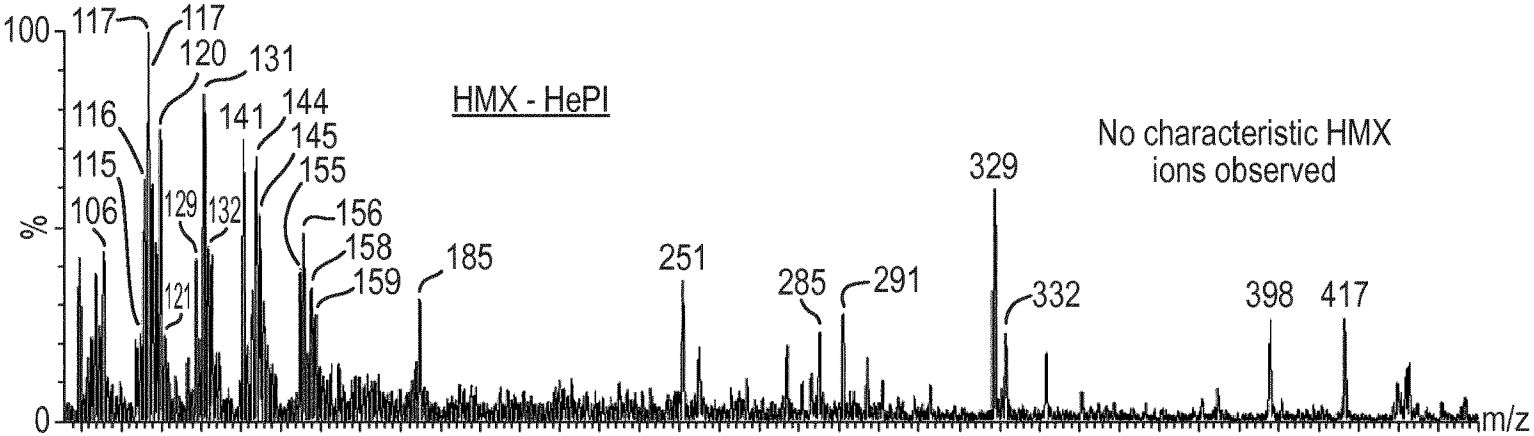
FIG. 3B shows a mass spectrum of a HMX sample obtained using a Helium Plasma Ionization (HePI) ion source.

FIG. 3A shows that the volatile TNT sample produces a strong negative ion mass spectrum where the base peaks are identified as the TNT ions $[M-H]^-$, $[M-OH]^-$ and $[M-NO]^-$. In contrast, the involatile HMX sample produces a low intensity spectrum (FIG. 3B) with no characteristic HMX ions and a low mass to charge ratio (m/z) region that is indicative of a hydrocarbon cracking pattern ($CH_2$ sub units) that may be HMX fragments or contamination in the source environment. This analysis suggests that HePI ionization can be utilized for sensitive ambient mass spectrometric detection of TNT but cannot efficiently detect HMX.

In contrast, the Applicants have found that the solvent-mediated techniques of SESI and AISI are particularly suitable for involatile analytes. A similar test was conducted with an AISI source for samples of TNT, RDX and HMX. Referring to the AISI schematic in FIG. 2, the temperature of the annular heater 4 was set to 600° C., the glass sample rod 9 was positioned at the heater exit and UPLC water (ELGA Purelab Ultra water) was sprayed through the grounded capillary 2 at a flow rate of 0.4 mL/min.

Figure 4A:
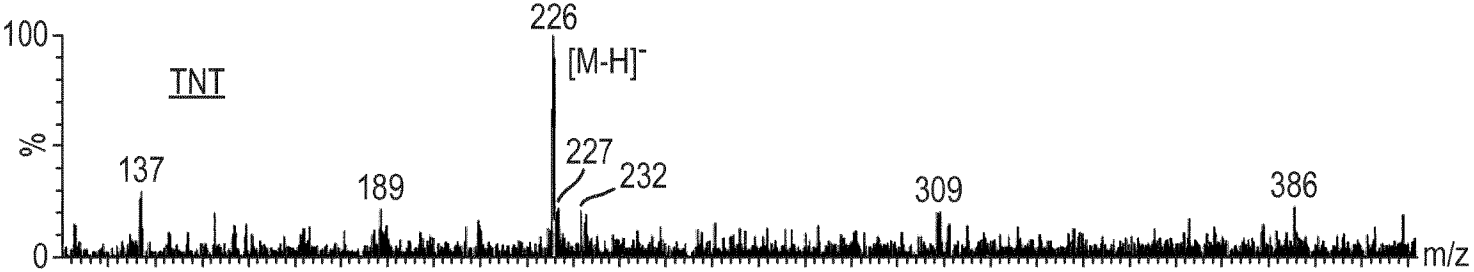
FIG. 4A shows a mass spectrum of a TNT sample obtained using an Ambient Impactor Spray Ionization (AISI) ion source.
Figure 4B:
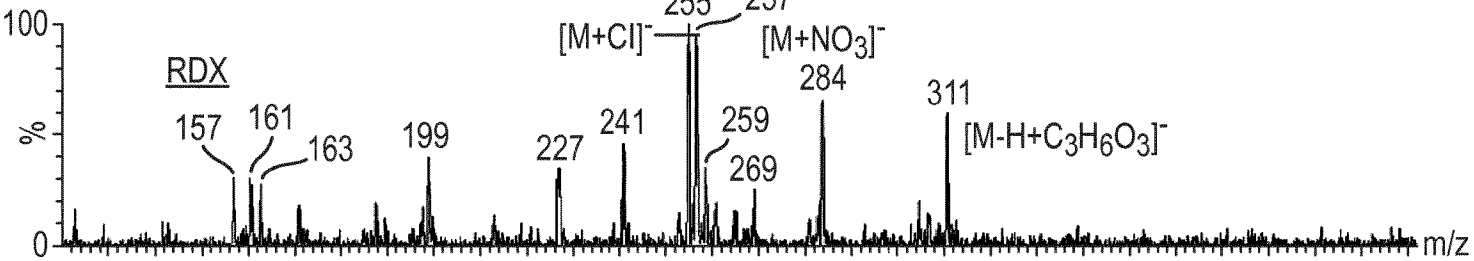
FIG. 4B shows a mass spectrum of an RDX sample obtained using an Ambient Impactor Spray Ionization (AISI) ion source.
Figure 4C:
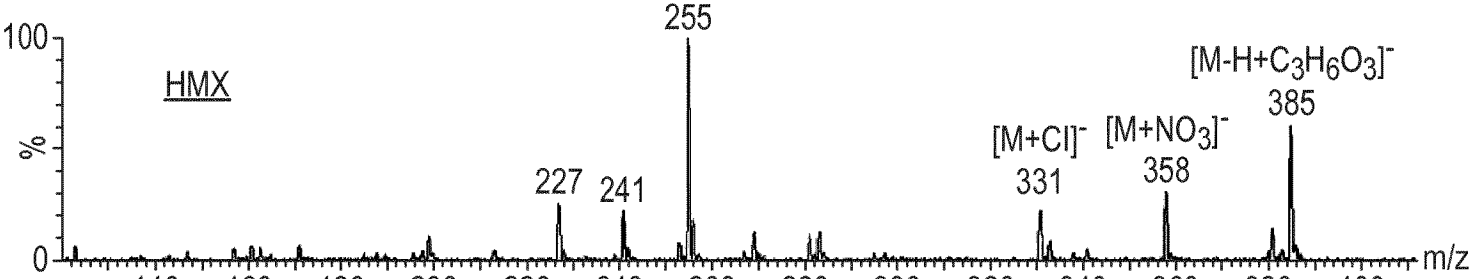
FIG. 4C shows a mass spectrum of a HMX sample obtained using an Ambient Impactor Spray Ionization (AISI) ion source.

FIG. 4 shows the resulting AISI mass spectra that were obtained for 2 ng samples of TNT, RDX and HMX. In contrast to the HePI data, AISI was able to produce characteristic negative ions for the volatile TNT sample and both the involatile RDX and HMX samples. The AISI TNT spectrum was dominated by the deprotonated molecule ($[M-H]^-$), whilst the RDX and HMX spectra were largely composed of the chloride ($[M+Cl]^-$), nitrate ($[M+NO_3]^-$) and lactate ($[M-H+C_3H_6O_3]^-$) adduct anions. The adduct ions described here were confirmed using an accurate mass, Time of Flight Mass Spectrometry (TOF-MS) technique which will be discussed in more detail below.

Figure 5A:
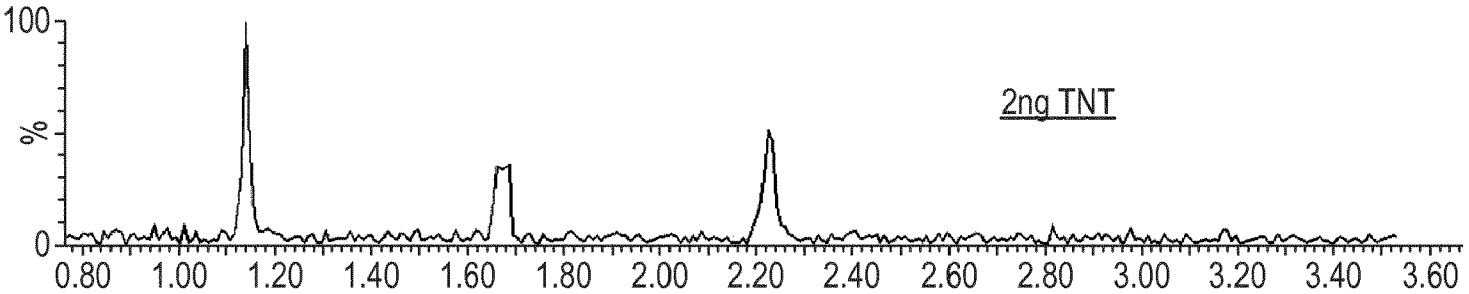
FIG. 5A shows a reconstructed ion chromatogram of a TNT sample obtained using an Ambient Impactor Spray Ionization (AISI) ion source.
Figure 5B:
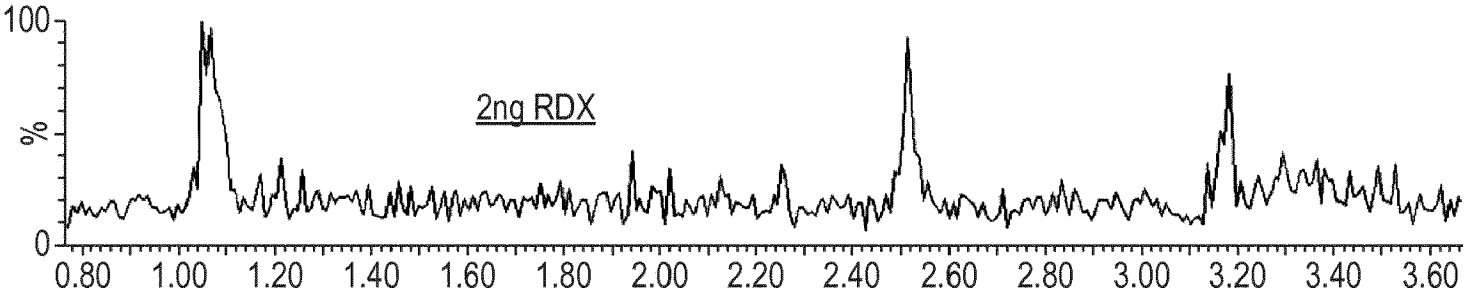
FIG. 5B shows a reconstructed ion chromatogram of an RDX sample obtained using an Ambient Impactor Spray Ionization (AISI) ion source.
Figure 5C:
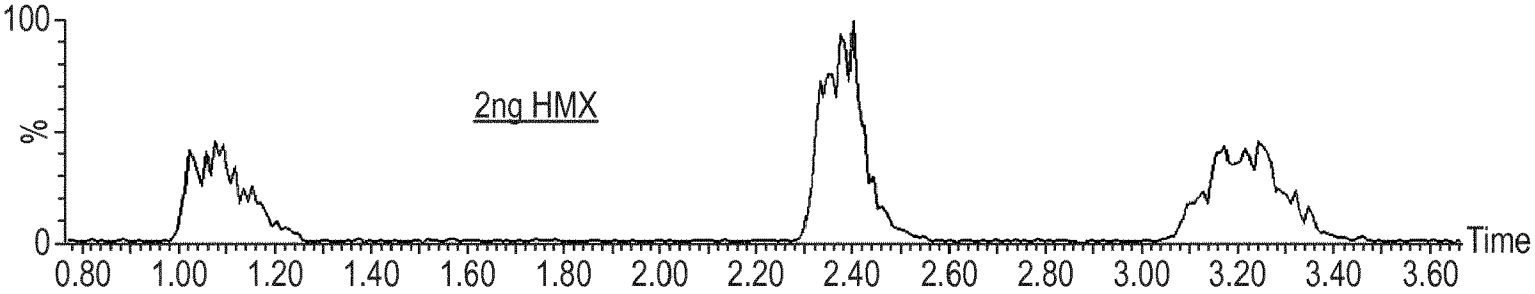
FIG. 5C shows a reconstructed ion chromatogram of a HMX sample obtained using an Ambient Impactor Spray Ionization (AISI) ion source.

To illustrate the detection capability of water-mediated AISI, FIG. 5 shows the reconstructed ion chromatograms (RIC) obtained for 3 repeat introductions of 2 ng samples of TNT, RDX and HMX. The TNT chromatogram corresponds to the deprotonated anion whilst the RDX and HMX chromatograms correspond to the lactate anions. It is noted in FIG. 5, that decreasing sample volatility leads to a significant increase in detected peak width, as would generally be expected. Nevertheless, the AISI source is shown to ionize the most involatile sample HMX with the greatest efficiency.

It also follows that a flash vaporization device could further increase the detection efficiency by reducing the chromatogram peak width and subsequently increasing the momentary sample concentration. Thus, according to various embodiments, the sample is heated by a flash vaporization device.

Any suitable flash vaporization device and/or technique may be used. For example, the temperature of the sample and/or sample target may be rapidly increased in order to effect flash vaporization.

Additionally or alternatively, the sample may be introduced (directly) to a heated surface, such as a hot metallic surface. The hot metallic surface may be visibly glowing red, e.g. may be at a temperature between 500 and 1000° C. In various embodiments, the surface may be at a temperature of (i) <500° C.; (ii) 500-600° C.; (iii) 600-700° C.; (iv) 700-800° C.; (v) 800-900° C.; (vi) 900-1000° C.; or >1000° C. The ion source and/or the surface may be arranged and/or configured such that volatilised sample is urged towards the charged particles (i.e. so as then to be ionized as described above). For example, the surface may utilise a flow of gas (i.e. a carrier gas) to urge the volatilised sample towards the charged particles (e.g. in the manner described above).

The origin of the lactate adduct ions may be due to the natural concentration of lactic acid in the environment, which could be further enhanced by the breath of the tester who is located at close proximity to the ionization source. Nevertheless, acids readily form anion adducts under liquid chromatography/mass spectrometry (LC/MS) conditions.

In order to determine whether any additional benefits could be obtained by forcing the ambient ionization process towards acid adduction, the experimental AISI method described above was repeated with the use of the same UPLC water as described above, but with the addition of 0.1% formic acid.

Figure 6A:
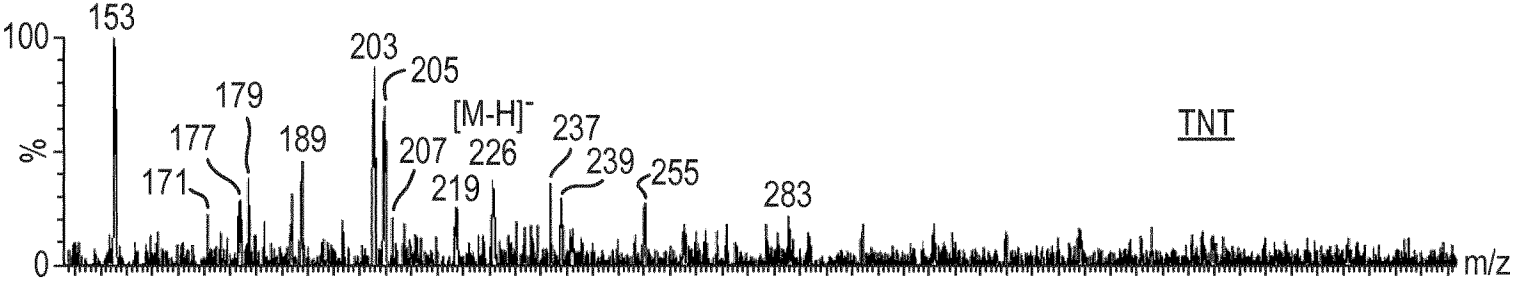
FIG. 6A shows a mass spectrum of a TNT sample obtained using an Ambient Impactor Spray Ionization (AISI) ion source using aqueous formic acid.
Figure 6B:
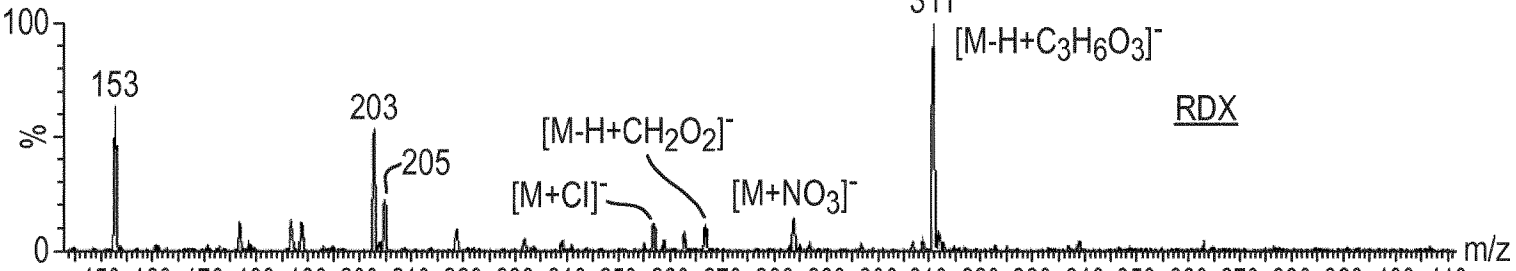
FIG. 6B shows a mass spectrum of an RDX sample obtained using an Ambient Impactor Spray Ionization (AISI) ion source using aqueous formic acid.
Figure 6C:
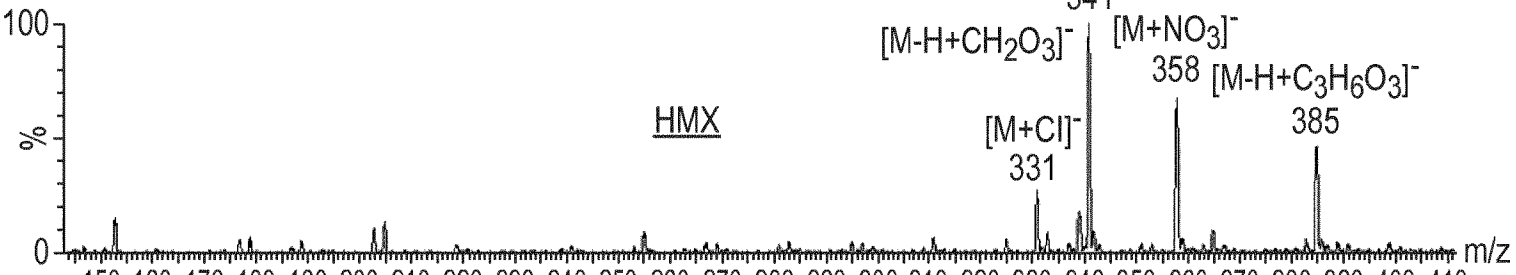
FIG. 6C shows a mass spectrum of a HMX sample obtained using an Ambient Impactor Spray Ionization (AISI) ion source using aqueous formic acid.

FIG. 6 shows the resulting AISI mass spectra obtained for 2 ng samples of TNT, RDX and HMX. FIGS. 6B and 6C show that the addition of formic acid gives rise to the detection of formate ions $[M-H+CH_2O_2]^-$ for the RDX and HMX samples.

Furthermore, compared to FIG. 4, the addition of formic acid also has the effect of increasing the intensity of the other adduct ions for HMX and RDX. (In this respect, it should be noted that in both the spectral and chromatographic data presented here, the number in the top right hand corner of each graph corresponds to the intensity of the response.)

Figure 7A:
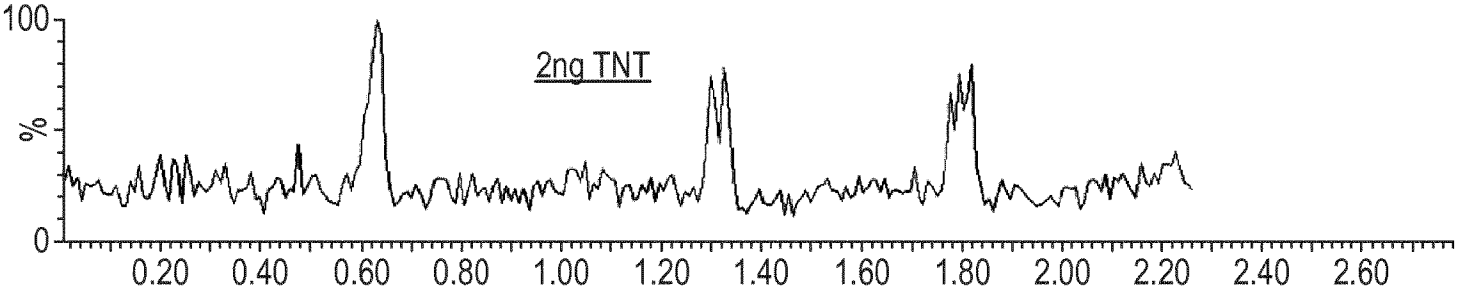
FIG. 7A shows a reconstructed ion chromatogram of a TNT sample obtained using an Ambient Impactor Spray Ionization (AISI) ion source using aqueous formic acid.
Figure 7B:
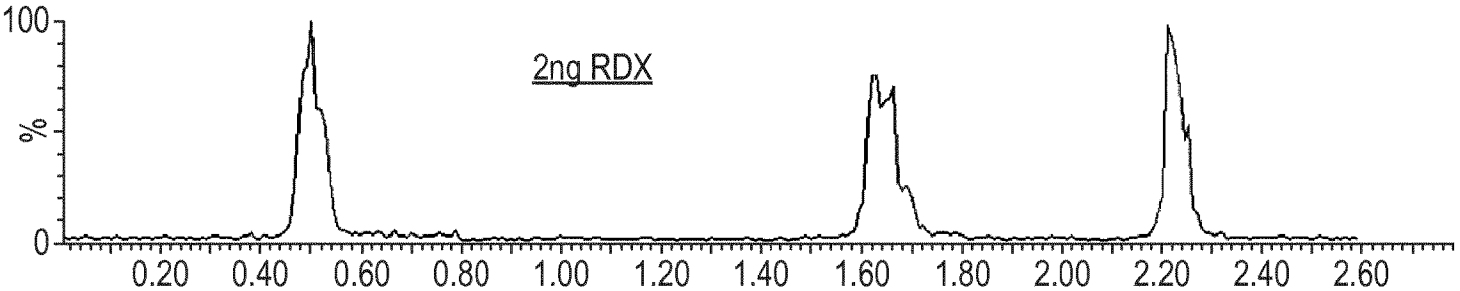
FIG. 7B shows a reconstructed ion chromatogram of an RDX sample obtained using an Ambient Impactor Spray Ionization (AISI) ion source using aqueous formic acid.
Figure 7C:
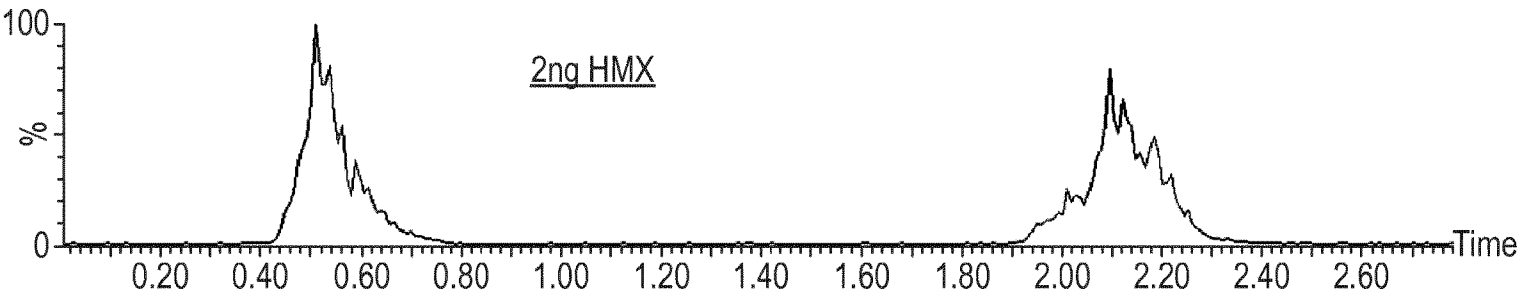
FIG. 7C shows a reconstructed ion chromatogram of a HMX sample obtained using an Ambient Impactor Spray Ionization (AISI) ion source using aqueous formic acid.

The RICs shown in FIG. 7 for the lactate and formate adducts of RDX and HMX, respectively, show that the addition of formic acid can significantly increase the detection efficiency for these involatile explosive samples.

Thus, comparing FIGS. 5 and 7, it is observed that the formic acid gives rise to approximately 9-fold and 4-fold enhancements in the signal intensity for RDX and HMX, respectively, when compared to AISI detection with only water. It follows that low picogram amounts of RDX and HMX can be detected by the use of multiple reaction monitoring (MRM) on a triple quadrupole mass spectrometer or a high sensitivity Q-TOF mass spectrometer.

One or more other organic acids could be used in place of formic acid.

It is clear from the data presented above, that AISI/MS is not particularly optimized for the detection of volatile explosives such as TNT. Furthermore, the TNT response is not found to benefit from the addition of formic acid to the AISI solvent.

It is plausible that the reduced response could at least in part be related to the sample introduction position where rapid volatilization of the small and mobile TNT molecules at the heater exit may result in larger losses due to diffusion in the source volume. These losses may be reduced by introducing the sample rod in the second position 11 shown in FIG. 2.

Here, the tip of the sample rod is placed typically 2 mm to the right (in the positive x-direction) of the high voltage target 7 in order to prevent direct contact with the spray from the nebulizer.

Figure 8A:
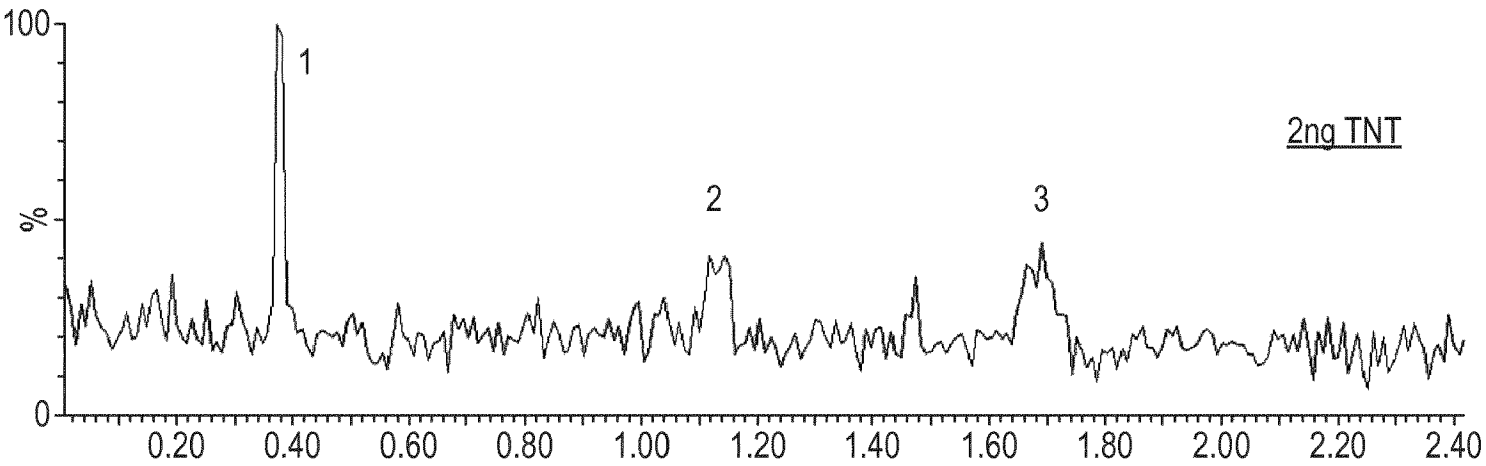
FIG. 8A shows a reconstructed ion chromatogram of a TNT sample obtained using an Ambient Impactor Spray Ionization (AISI) ion source using aqueous formic acid where the sample is located at the outlet of the ion source's desolvation heater.

FIG. 8A shows the response obtained for 3 repeat introductions of a 2 ng TNT sample into the AISI source with 0.1% aqueous formic acid at a flow rate of 0.4 mL/min and with the sample located at the end of the annular heater (the first sample rod position 9 in FIG. 2).

Figure 8B:
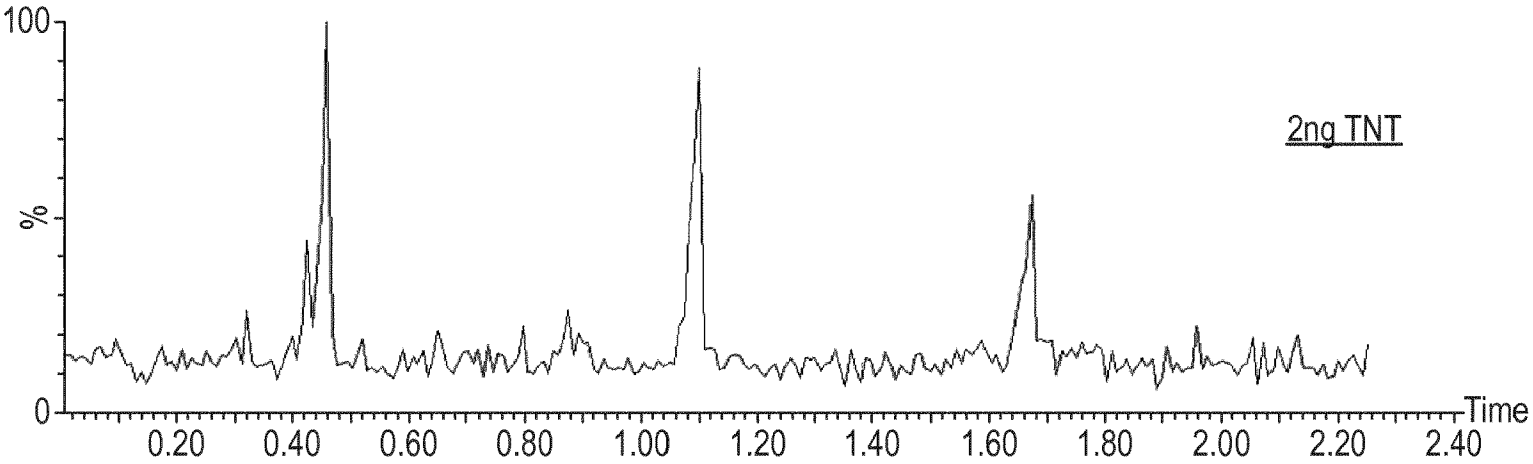
FIG. 8B shows a reconstructed ion chromatogram of a TNT sample obtained using an Ambient Impactor Spray Ionization (AISI) ion source using aqueous formic acid where the sample is located close to the ion source's impactor target.

In comparison, FIG. 8B shows that the response for a 2 ng TNT sample is improved by introducing the sample rod close to the high voltage target (the second sample rod position 11 in FIG. 2).

Although no data is shown, the involatile samples RDX and HMX give better responses when the sample is introduced at the exit of the heater where the local gas temperature is higher.

Thus according to various embodiments, a sample may be positioned at either the first sample position 9 or the second sample position 11, depending on whether the sample is relatively involatile or relatively volatile.

As discussed above, the term "ambient ionization" refers to the fact that samples are introduced into an ionization region that is open, at least to some extent, to the environment that surrounds the operator. As such, there is a requirement from a health and safety perspective to protect the operator from harmful substances that may be used in the ambient ionization method. With this requirement in mind, all the data presented thus far were obtained with an AISI spray solvent that consists primarily of water. There are, however, some advantages to using other organic solvents such acetonitrile and methanol which are commonly used in liquid chromatography mobile phases.

Figure 9:
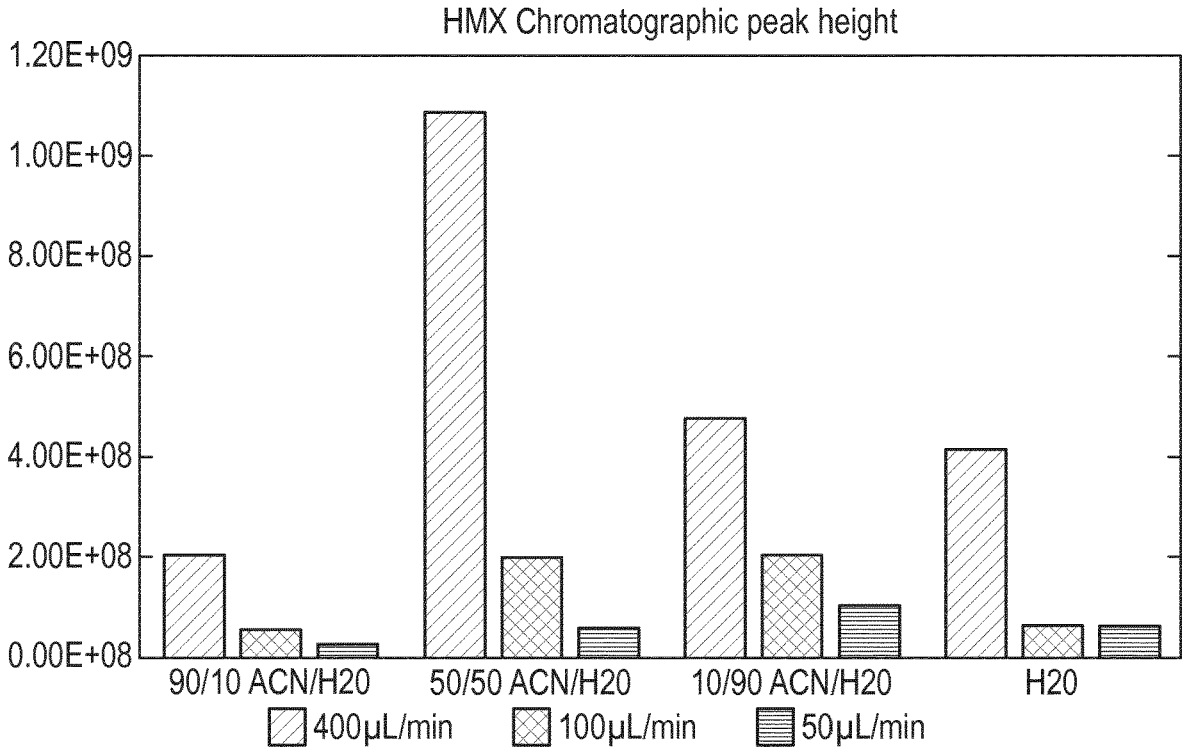
FIG. 9 shows a graph of chromatographic peak heights of a HMX sample obtained using an Ambient Impactor Spray Ionization (AISI) ion source using a variety of solvents and a variety of solvent flow rates.

FIG. 9 compares the chromatographic peak heights obtained from a similar study of explosives using AISI/MS. FIG. 9 shows that the maximum HMX response for all the different solvent compositions was obtained at the higher flow rate of 0.4 mL/min.

Furthermore, the highest response for HMX was obtained with a 50/50 mixture of ACN/$H_2O$ (acetonitrile/water) whilst the lowest response was observed for a 90/10 ACN/$H_2O$ mixture.

According to various embodiments, the system may comprise a pseudo-sealed source enclosure, including sample automation if required, e.g. so as to minimize the toxicity risk to the operator whilst delivering maximum detection efficiency.

As mentioned above, the solvent mediated techniques of AISI and SESI differ from ambient sources that are based on discharge ionization in that they utilize a charged aerosol to effect ionization. SESI can also produce enhanced sensitivity for involatile explosives in accordance with various embodiments.

Figure 10:
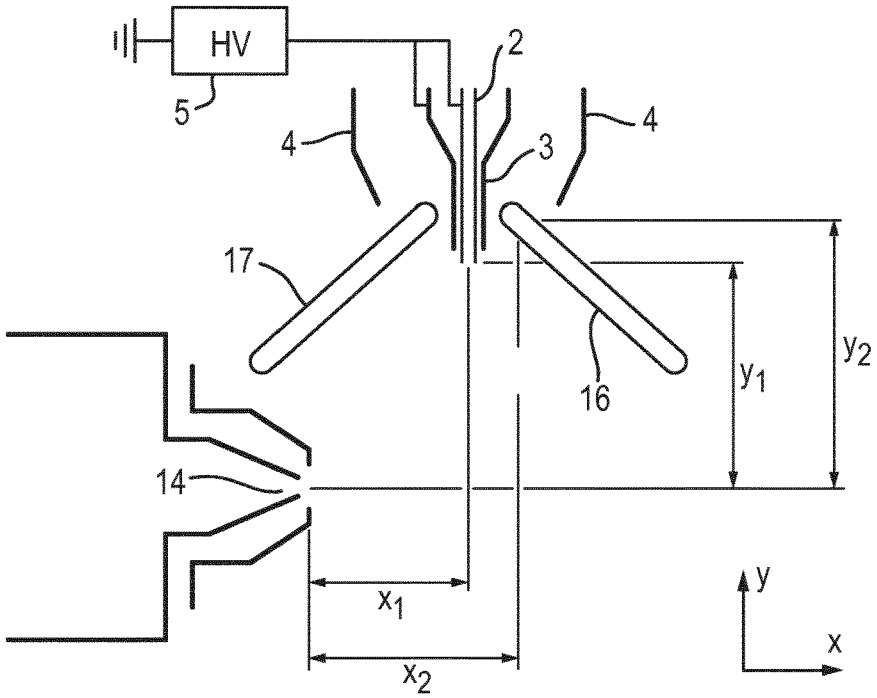
FIG. 10 shows schematically a Secondary Electrospray Ionization (SESI) ion source in accordance with various embodiments.

FIG. 10 shows schematically a SESI source in accordance with various embodiments, where a liquid capillary 2 and a nebuliser capillary 3 are biased to typically around −1.0 kV by a high voltage power supply 5 to create an electrospray plume.

In a similar manner to that described for the AISI analysis of explosives, a sample can be applied to the tip of a glass rod 16, 17 and the tip can be positioned at the exit of the annular heater 4. According to various embodiments, the position of the sample is found to significantly influence the detection efficiency in this mode of operation.

Figure 11A:
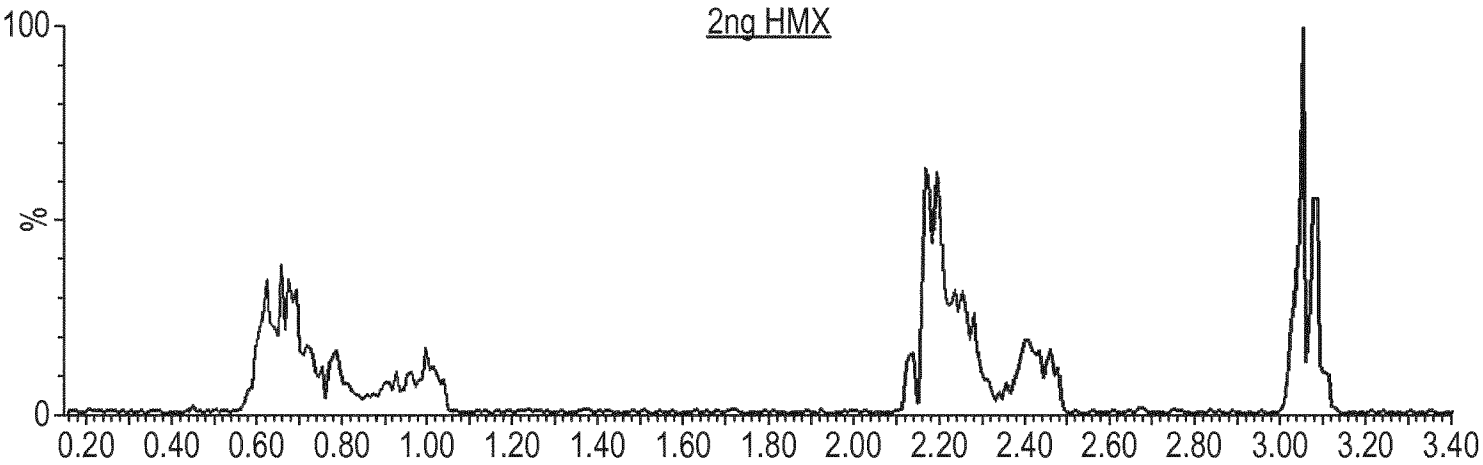
FIG. 11A shows a reconstructed ion chromatogram of a HMX sample obtained using a Secondary Electrospray Ionization (SESI) ion source where the sample is located at the outlet of the ion source's desolvation heater at the furthest point from the ion inlet of the mass spectrometer.

FIG. 11A shows that broad and erratic chromatogram peaks are obtained for repeat introductions of a 2 ng HMX sample (monitored on the chloride anion) using a sample rod 16 positioned away from the ion inlet in FIG. 10. The data were obtained with a solvent consisting of 50/50 ACN/$H_2O$ (no acid) at a flow rate of 0.4 mL/min.

Figure 11B:
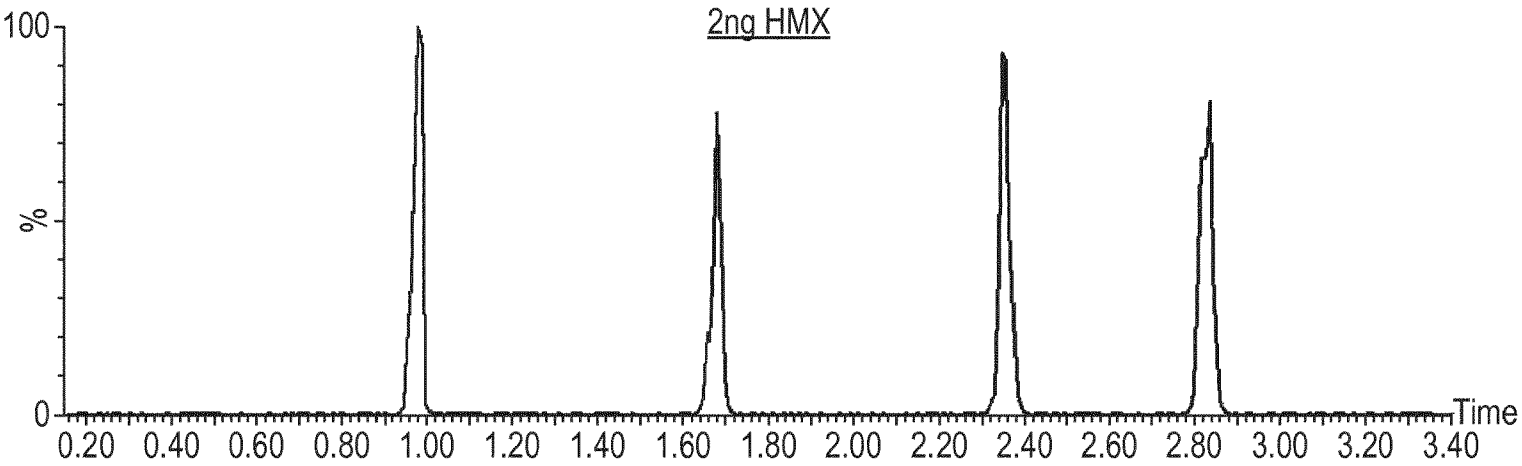
FIG. 11B shows a reconstructed ion chromatogram of a HMX sample obtained using a Secondary Electrospray Ionization (SESI) ion source where the sample is located at the outlet of the ion source's desolvation heater at the closest point to the ion inlet of the mass spectrometer.

FIG. 11B shows that the intensity and reproducibility of the detection method can be greatly improved by locating the using the sample rod position 17 in FIG. 10 where the tip is located on the same side as the ion inlet cone 14 of the mass spectrometer.

Sensitivity may be hindered with sample rod position 16 due to the fact that ionized sample has to traverse the high velocity electrospray plume in order to reach the ion inlet orifice 14. This is different to the AISI source where the outer sample position (position 9 in FIG. 2) is preferred due to the "steering" effect of the Coanda gas streamlines 8 that flow between the outer surface of the target 7 and the ion inlet cone 14.

The SESI peak intensity in FIG. 11B was similar although reduced compared to the AISI response (data not shown), but it is anticipated that the AISI response would be significantly greater for highly aqueous solutions that are preferred in commercial ambient detection systems.

The methods described herein advocate the use of acids in an AISI ambient ionization source to enhance the formation of acid-adduct anions. In order to confirm that the ion structures were as postulated in FIGS. 4 and 6, the AISI/MS method for RDX and HMX was repeated on a quadrupole-time of flight (Q-TOF) mass spectrometer system that can routinely measure the mass accuracy of ions to less than 5 ppm.

Table 1 compares the expected mass, determined mass and the mass error between the two values in ppm for the postulated ions. The expected mass is calculated from the chemical formulae for the proposed structures and the determined mass is the measured mass from the Q-TOF MS instrument. The accurate mass spectra were internally calibrated using a single-point calibration on the $^{35}Cl$ isotope of the RDX and HMX chloride anions. These ions were chosen since they gave additional mass assignment specificity from the ratios of the $^{35}Cl/^{37}Cl$ isotopes.

As shown in Table 1, the mass error for all the proposed anions is less than 2.3 ppm which strongly supports the postulated formulae shown in FIGS. 4 and 6.

According to various embodiments, the AISI method and hardware can be adapted to include a number of different sample introduction methods such as swabs, swab/thermal desorption units, etc.

In general, various embodiments are applicable to a wide range of involatile organic analytes such as oil samples and fuel additives, etc.

Various embodiments provide a fast, novel and sensitive way of detecting involatile explosives without the need for sample preparation.

TABLE 1

| Analyte Ion | Expected Mass | Determined Mass | Mass Error (ppm) |
|---|---|---|---|
| $[RDX + Cl]^-$ | 257.0037 | 257.0034 | −1.2 |
| $[RDX + NO_2]^-$ | 284.0227 | 284.023 | 1.1 |
| $[RDX - H + CH_2O_2]^-$ | 267.0325 | 267.0329 | 1.5 |
| $[RDX - H + C_3H_6O_3]^-$ | 311.0587 | 311.0595 | 2.3 |
| $[HMX + Cl]^-$ | 331.0154 | 331.0156 | 0.6 |
| $[HMX + NO_2]^-$ | 358.0343 | 358.0343 | 1.4 |
| $[HMX - H + CH_2O_2]^-$ | 341.0442 | 341.0446 | 1.2 |
| $[HMX - H + C_3H_6O_3]^-$ | 385.0704 | 385.0712 | 2.1 |

Although the present invention has been described with reference to preferred embodiments, it will be understood by those skilled in the art that various changes in form and detail may be made without departing from the scope of the invention as set forth in the accompanying claims.

The invention claimed is:

1. A method of ionizing a sample comprising:

providing a sample on a sample support;

heating the sample so that analyte is released from the sample;

producing charged particles downstream of the sample by causing droplets to impact upon an impactor target, wherein the charged particles comprise charged droplets, and wherein the impactor target is located downstream of the sample; and using the charged particles to ionize at least some of the analyte released from the sample so as to produce analyte ions.

2. The method of claim 1, wherein the charged droplets comprise charged solvent droplets.

3. The method of claim 1, wherein the charged droplets comprise (i) water; (ii) formic acid and/or another organic acid; (iii) acetonitrile;

and/or (iv) methanol.

4. The method of claim 1, wherein:

the droplets are emitted from a sprayer outlet; and the sprayer outlet is located downstream of the sample.

5. The method of claim 4, further comprising passing the analyte ions to an analytical instrument via an ion inlet; wherein:

the sprayer outlet is located at a first distance $x_1$ in a first direction from the ion inlet;

the sample is located at a second distance $x_2$ in the first direction from the ion inlet; and the second distance $x_2$ is larger than the first distance $x_1$.

6. The method of claim 1, wherein producing charged particles downstream of the sample comprises providing liquid to a sprayer with a flow rate of (i) ≥100 μL/min; (ii) ≥200 μL/min; (iii) ≥300 μL/min; (iv) ≥400 μL/min; or (v) ≥500 μL/min.

7. The method of claim 1, wherein heating the sample comprises:

emitting a heated gas from a heated gas outlet; and using the heated gas to heat the sample so that the analyte is released from the sample;

wherein the sample is located downstream of the heated gas outlet.

8. The method of claim 7, further comprising the heated gas urging at least some of the analyte released from the sample downstream of the sample so that at least some of the analyte is ionized by the charged particles.

9. The method of claim 1, wherein heating the sample comprises heating the sample using a flash vaporization device.

10. The method of claim 1, further comprising:

performing the steps of heating the sample, producing charged particles downstream of the sample, and using the charged particles to ionize at least some of the analyte in a first mode of operation; and in a second different mode of operation producing charged particles upstream of the sample, and using the charged particles to ionize at least some of the sample so as to produce analyte ions.

11. The method of claim 1, wherein the method is performed at ambient and/or atmospheric conditions.

12. A method of analysing a sample comprising:

ionizing a sample using the method of claim 1;

analysing the analyte ions; and determining whether the analyte comprises an involatile substance on the basis of the analysis.

13. The method of claim 12, further comprising determining whether the sample comprises an involatile explosive on the basis of the analysis.

14. The method of claim 1, wherein the droplets are emitted from a sprayer and wherein the droplets emitted from the sprayer are substantially electrically neutral.

15. The method of claim 1, wherein the impactor target is located downstream of the sample support.

16. An ion source comprising:

a sample support configured to provide a sample;

one or more heating devices configured to heat the sample to cause analyte to be released from the sample; and one or more charged particle sources configured to produce charged particles downstream of the sample, wherein the charged particles comprise charged droplets, wherein the one or more charged particle sources comprises one or more impactor targets located downstream of the sample, and wherein the ion source is configured such that droplets are caused to impact upon the impactor target;

wherein the ion source is further configured such that at least some analyte released from the sample is ionized by the charged particles.

17. The ion source of claim 16, wherein the impactor target is located downstream of the sample support.

* * * * *